US008784174B2

(12) United States Patent
Basallo et al.

(10) Patent No.: US 8,784,174 B2
(45) Date of Patent: Jul. 22, 2014

(54) GAMING SYSTEM AND METHOD FOR PROVIDING AN OFFER AND ACCEPTANCE GAME

(71) Applicant: IGT, Reno, NV (US)

(72) Inventors: Leandro Basallo, San Francisco, CA (US); Scott A. Caputo, Santa Clara, CA (US); Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 169 days.

(21) Appl. No.: 13/626,312

(22) Filed: Sep. 25, 2012

(65) Prior Publication Data

US 2014/0087860 A1 Mar. 27, 2014

(51) Int. Cl.
*G07F 17/32* (2006.01)

(52) U.S. Cl.
USPC ..... 463/16; 463/20; 463/25; 463/29; 463/31

(58) Field of Classification Search
USPC ..... 463/16, 20, 25, 29, 31
See application file for complete search history.

(56) References Cited

U.S. PATENT DOCUMENTS

| | | | |
|---|---|---|---|
| 1,527,929 | A | 2/1925 | Simons |
| 2,545,644 | A | 3/1951 | Benton et al. |
| 3,167,313 | A | 1/1965 | Davenport et al. |
| 3,975,022 | A | 8/1976 | Figueroa |
| 4,003,578 | A | 1/1977 | Jones |
| 4,051,939 | A | 10/1977 | Murphy et al. |
| 4,182,515 | A | 1/1980 | Nemeth |
| 4,277,067 | A | 7/1981 | Gettleman |
| 4,323,242 | A | 4/1982 | Rosenfeld |
| 4,410,178 | A | 10/1983 | Partridge |
| 4,448,419 | A | 5/1984 | Telnaes |
| 4,508,353 | A | 4/1985 | Meyer et al. |
| 4,511,143 | A | 4/1985 | Sankrithi |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,732,386 | A | 3/1988 | Rayfiel |
| 4,775,155 | A | 10/1988 | Lees |
| 4,850,592 | A | 7/1989 | Winter |
| 4,991,848 | A | 2/1991 | Greenwood et al. |
| 5,046,737 | A | 9/1991 | Fienberg |
| 5,058,893 | A | 10/1991 | Dickinson et al. |
| 5,072,946 | A | 12/1991 | Miller |
| 5,083,800 | A | 1/1992 | Lockton |

(Continued)

FOREIGN PATENT DOCUMENTS

| | | |
|---|---|---|
| EP | 0 945 837 | 9/1999 |
| EP | 0 984 409 | 3/2000 |

(Continued)

*Primary Examiner* — Omkar Deodhar
(74) *Attorney, Agent, or Firm* — Neal, Gerber & Eisenberg LLP

(57) ABSTRACT

A gaming system including an offer and acceptance game including a series of offer component accumulations. One or more accumulated offer components are associated with one or more award values which form different offers for acceptance or rejection. One or more of such offer component accumulations are also associated with an elimination of one or more of any previously accumulated offer components. Such a configuration provides that when deciding whether to accept an offer (including the currently accumulated, non-eliminated offer components) or reject the offer and accumulate additional offer components, a player weighs the risks of eliminating one or more previously accumulated offer components.

28 Claims, 17 Drawing Sheets

(56) References Cited

U.S. PATENT DOCUMENTS

| | | | |
|---|---|---|---|
| 5,116,055 | A | 5/1992 | Tracy |
| 5,152,529 | A | 10/1992 | Okada |
| 5,178,395 | A | 1/1993 | Lovell |
| 5,205,555 | A | 4/1993 | Hamano |
| 5,324,041 | A | 6/1994 | Boylan et al. |
| 5,333,868 | A | 8/1994 | Goldfarb |
| 5,342,047 | A | 8/1994 | Heidel et al. |
| 5,364,100 | A | 11/1994 | Ludlow et al. |
| 5,380,007 | A | 1/1995 | Travis et al. |
| 5,393,057 | A | 2/1995 | Marnell, II |
| 5,395,111 | A | 3/1995 | Inoue |
| 5,411,271 | A | 5/1995 | Mirando |
| 5,423,539 | A | 6/1995 | Nagao |
| 5,449,173 | A | 9/1995 | Thomas et al. |
| 5,456,465 | A | 10/1995 | Durham |
| 5,501,455 | A | 3/1996 | Hirata et al. |
| 5,511,781 | A | 4/1996 | Wood et al. |
| 5,515,486 | A | 5/1996 | Amro et al. |
| 5,531,441 | A | 7/1996 | Dabrowski et al. |
| 5,536,016 | A | 7/1996 | Thompson |
| 5,542,669 | A | 8/1996 | Charron et al. |
| 5,560,603 | A | 10/1996 | Seelig et al. |
| 5,566,942 | A | 10/1996 | Elum |
| 5,570,885 | A | 11/1996 | Ornstein |
| 5,584,763 | A | 12/1996 | Kelly et al. |
| 5,607,162 | A | 3/1997 | Boylan et al. |
| 5,611,535 | A | 3/1997 | Tiberio et al. |
| 5,611,730 | A | 3/1997 | Weiss |
| 5,664,998 | A | 9/1997 | Seelig et al. |
| 5,707,285 | A | 1/1998 | Place et al. |
| 5,711,525 | A | 1/1998 | Breeding |
| 5,722,891 | A | 3/1998 | Inoue |
| 5,769,716 | A | 6/1998 | Saffari et al. |
| 5,772,509 | A | 6/1998 | Weiss |
| 5,788,573 | A | 8/1998 | Baerlocher et al. |
| 5,788,574 | A | 8/1998 | Ornstein et al. |
| 5,813,672 | A | 9/1998 | Loud, Jr. |
| 5,823,872 | A | 10/1998 | Prather et al. |
| 5,823,874 | A | 10/1998 | Adams |
| D400,597 | S | 11/1998 | Hedrick et al. |
| 5,833,536 | A | 11/1998 | Davids et al. |
| 5,833,537 | A | 11/1998 | Barrie |
| 5,833,538 | A | 11/1998 | Weiss |
| D402,702 | S | 12/1998 | Seelig et al. |
| 5,848,932 | A | 12/1998 | Adams |
| 5,851,147 | A | 12/1998 | Stupak et al. |
| 5,851,148 | A | 12/1998 | Brune et al. |
| 5,855,514 | A | 1/1999 | Kamille |
| 5,855,515 | A | 1/1999 | Pease et al. |
| 5,873,781 | A | 2/1999 | Keane |
| D406,865 | S | 3/1999 | Heidel |
| 5,882,261 | A | 3/1999 | Adams |
| 5,885,158 | A | 3/1999 | Torango et al. |
| 5,902,184 | A | 5/1999 | Bennett |
| 5,911,418 | A | 6/1999 | Adams et al. |
| 5,919,091 | A | 7/1999 | Bell et al. |
| 5,927,714 | A | 7/1999 | Kaplan |
| 5,935,002 | A | 8/1999 | Falciglia |
| 5,944,314 | A | 8/1999 | Stavinsky |
| 5,947,820 | A | 9/1999 | Morro et al. |
| 5,951,397 | A | 9/1999 | Dickinson |
| 5,964,463 | A | 10/1999 | Moore, Jr. |
| 5,976,015 | A | 11/1999 | Seelig et al. |
| 5,980,384 | A | 11/1999 | Barrie |
| 5,984,781 | A | 11/1999 | Sunaga |
| 5,988,643 | A | 11/1999 | Awada |
| 5,989,121 | A | 11/1999 | Sakamoto |
| 5,996,997 | A | 12/1999 | Kamille |
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,019,369 | A | 2/2000 | Nakagawa et al. |
| 6,024,642 | A | 2/2000 | Stupak |
| 6,033,306 | A | 3/2000 | De Souza |
| 6,033,307 | A | 3/2000 | Vancura |
| 6,039,649 | A | 3/2000 | Schulze |
| 6,053,813 | A | 4/2000 | Mathis |
| 6,056,642 | A | 5/2000 | Bennett |
| 6,059,289 | A | 5/2000 | Vancura |
| 6,059,658 | A | 5/2000 | Mangano et al. |
| 6,086,066 | A | 7/2000 | Takeuchi et al. |
| 6,089,976 | A | 7/2000 | Schneider et al. |
| 6,089,977 | A | 7/2000 | Bennett |
| 6,089,978 | A | 7/2000 | Adams |
| 6,102,400 | A | 8/2000 | Scott et al. |
| 6,102,402 | A | 8/2000 | Scott et al. |
| 6,102,798 | A | 8/2000 | Bennett |
| 6,105,962 | A | 8/2000 | Malavazos et al. |
| 6,113,098 | A | 9/2000 | Adams |
| 6,126,542 | A | 10/2000 | Fier |
| 6,129,355 | A | 10/2000 | Hahn et al. |
| 6,134,556 | A | 10/2000 | Shin |
| 6,135,884 | A | 10/2000 | Hedrick et al. |
| 6,142,873 | A | 11/2000 | Weiss et al. |
| 6,142,874 | A | 11/2000 | Kodachi et al. |
| 6,149,521 | A | 11/2000 | Sanduski |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,164,652 | A | 12/2000 | Lauretta et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,234 | B1 | 1/2001 | Seibert, Jr. et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,193,606 | B1 | 2/2001 | Walker et al. |
| 6,203,429 | B1 | 3/2001 | Demar et al. |
| 6,203,430 | B1 | 3/2001 | Walker et al. |
| 6,210,275 | B1 | 4/2001 | Olsen |
| 6,213,876 | B1 | 4/2001 | Moore, Jr. |
| 6,220,593 | B1 | 4/2001 | Pierce et al. |
| 6,224,483 | B1 | 5/2001 | Mayeroff |
| 6,227,969 | B1 | 5/2001 | Yoseloff |
| 6,227,970 | B1 | 5/2001 | Shimizu et al. |
| 6,227,971 | B1 | 5/2001 | Weiss |
| 6,231,442 | B1 | 5/2001 | Mayeroff |
| 6,234,897 | B1 | 5/2001 | Frohm et al. |
| D443,313 | S | 6/2001 | Brettschneider |
| 6,251,013 | B1 | 6/2001 | Bennett |
| 6,254,481 | B1 | 7/2001 | Jaffe |
| 6,261,177 | B1 | 7/2001 | Bennett |
| 6,267,669 | B1 | 7/2001 | Luciano, Jr. et al. |
| 6,270,411 | B1 | 8/2001 | Gura et al. |
| 6,273,420 | B1 | 8/2001 | Brooks |
| 6,279,910 | B1 | 8/2001 | de Keller |
| 6,287,197 | B1 | 9/2001 | Dickinson et al. |
| 6,299,165 | B1 | 10/2001 | Nagano |
| 6,302,790 | B1 | 10/2001 | Brossard |
| 6,305,686 | B1 | 10/2001 | Perrie et al. |
| 6,309,299 | B1 | 10/2001 | Weiss |
| 6,309,300 | B1 | 10/2001 | Glavich |
| 6,312,332 | B1 | 11/2001 | Walker et al. |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,315,664 | B1 | 11/2001 | Baerlocher et al. |
| 6,319,124 | B1 | 11/2001 | Baerlocher et al. |
| 6,322,309 | B1 | 11/2001 | Thomas et al. |
| 6,328,649 | B1 | 12/2001 | Randall et al. |
| 6,336,860 | B1 | 1/2002 | Webb |
| 6,336,863 | B1 | 1/2002 | Baerlocher et al. |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| 6,364,767 | B1 | 4/2002 | Brossart et al. |
| 6,368,216 | B1 | 4/2002 | Hedrick et al. |
| 6,368,218 | B2 | 4/2002 | Angell, Jr. |
| 6,375,187 | B1 | 4/2002 | Baerlocher |
| 6,386,974 | B1 | 5/2002 | Adams |

(56) References Cited

U.S. PATENT DOCUMENTS 6,398,220 B1 6/2002 Inoue
6,398,644 B1 6/2002 Perrie et al.
6,406,369 B1 6/2002 Baerlocher et al.
6,409,172 B1 6/2002 Vancura
6,413,161 B1 7/2002 Baerlocher et al.
6,419,579 B1 7/2002 Bennett et al.
6,425,824 B1 7/2002 Baerlocher et al.
6,435,500 B2 8/2002 Gumina
6,435,511 B1 8/2002 Vancura et al.
6,439,995 B1 8/2002 Hughs-Baird et al.
6,450,883 B1 9/2002 O'Halloran
6,461,241 B1 10/2002 Webb et al.
D465,531 S 11/2002 Luciano, Jr. et al.
6,481,713 B2 11/2002 Perrie et al.
6,494,785 B1 12/2002 Gerrard et al.
6,506,117 B2 1/2003 DeMar et al.
6,506,118 B1 1/2003 Baerlocher et al.
6,511,375 B1 1/2003 Kaminkow
6,514,141 B1 2/2003 Kaminkow et al.
6,533,660 B2 3/2003 Seelig et al.
6,537,152 B2 3/2003 Seelig et al.
6,558,254 B2 5/2003 Baelocher et al.
6,561,902 B1 5/2003 Walker et al.
6,569,015 B1 5/2003 Baerlocher et al.
6,572,469 B2 6/2003 Klitsner et al.
6,572,471 B1 6/2003 Bennett
6,572,473 B1 6/2003 Baerlocher
6,582,307 B2 6/2003 Webb
6,585,591 B1 7/2003 Baerlocher et al.
6,589,117 B1 7/2003 Moritome et al.
6,592,457 B1 7/2003 Frohm et al.
6,595,854 B2 7/2003 Hughs-Baird et al.
6,599,185 B1 7/2003 Kaminkow et al.
6,599,192 B1 7/2003 Baerlocher et al.
6,602,135 B1 8/2003 Gerrard
6,602,136 B1 8/2003 Baerlocher et al.
6,602,137 B2 8/2003 Kaminkow et al.
6,607,438 B2 8/2003 Baerlocher et al.
6,609,972 B2 8/2003 Seelig et al.
6,609,974 B2 8/2003 Mead et al.
6,632,140 B2 10/2003 Berman et al.
6,632,141 B2 10/2003 Webb et al.
6,634,943 B1 10/2003 Baerlocher
6,634,945 B2 10/2003 Glavich et al.
6,638,164 B2 10/2003 Randall et al.
6,645,074 B2 11/2003 Thomas et al.
6,648,754 B2 11/2003 Baerlocher et al.
6,648,757 B1 11/2003 Slomiany et al.
6,668,975 B2 12/2003 Skipper
6,669,559 B1 12/2003 Baerlocher et al.
6,676,516 B2 1/2004 Baerlocher et al.
6,688,975 B2 2/2004 Baerlocher et al.
6,692,356 B2 2/2004 Baerlocher et al.
6,712,694 B1 3/2004 Nordman
6,719,632 B2 4/2004 Palmer et al.
6,722,981 B2 4/2004 Kaminkow et al.
6,722,982 B2 4/2004 Kaminkow et al.
6,722,983 B2 4/2004 Kaminkow et al.
6,726,563 B1 4/2004 Baerlocher et al.
6,733,386 B2 5/2004 Cuddy et al.
6,743,096 B2 6/2004 Allendorf et al.
6,749,502 B2 6/2004 Baerlocher
6,749,504 B2 6/2004 Hughs-Baird
6,758,747 B2 7/2004 Baerlocher
6,761,632 B2 7/2004 Bansemer et al.
6,769,983 B2 8/2004 Slomiany
6,780,103 B2 8/2004 Bansemer et al.
6,780,107 B2 8/2004 Baerlocher et al.
6,780,110 B2 8/2004 Baerlocher et al.
6,780,111 B2 8/2004 Cannon et al.
6,783,457 B2 8/2004 Hughs-Baird et al.
6,783,458 B2 8/2004 Mead et al.
6,786,820 B2 9/2004 Gerrard et al.
6,796,899 B2 9/2004 Baerlocher
6,796,900 B2 9/2004 Baerlocher et al.
6,802,773 B2 10/2004 Moody
6,808,452 B2 10/2004 Baerlocher et al.
6,808,454 B2 10/2004 Gerrard et al.
6,811,482 B2 11/2004 Letovsky
6,811,483 B1 11/2004 Webb et al.
6,814,664 B2 11/2004 Baerlocher et al.
6,817,943 B2 11/2004 Gerrard
6,817,944 B2 11/2004 Kaminkow et al.
6,837,793 B2 1/2005 McClintic
6,843,721 B2 1/2005 Vancura
6,843,722 B2 1/2005 Webb
6,857,958 B2 2/2005 Osawa
6,860,810 B2 3/2005 Cannon et al.
6,863,606 B1 3/2005 Berg et al.
6,863,607 B2 3/2005 Gerrard
6,875,108 B1 4/2005 Hughs-Baird
6,878,061 B2 4/2005 Baerlocher et al.
6,890,257 B2 5/2005 Baerlocher
6,899,620 B2 5/2005 Kaminkow et al.
6,902,478 B2 6/2005 McClintic
6,908,383 B2 6/2005 Baerlocher et al.
6,910,962 B2 6/2005 Marks et al.
6,913,533 B2 7/2005 Cuddy et al.
6,913,535 B2 7/2005 Kaminkow et al.
6,918,830 B2 7/2005 Baerlocher
6,932,701 B2 8/2005 Glavich et al.
6,942,566 B2 9/2005 Baerlocher et al.
6,942,567 B2 9/2005 Baerlocher et al.
6,958,013 B2 10/2005 Miereau et al.
6,960,132 B2 11/2005 Baerlocher et al.
6,964,608 B1 11/2005 Koza
6,966,833 B2 11/2005 Kaminkow et al.
6,971,954 B2 12/2005 Randall et al.
6,991,538 B2 1/2006 Cannon
6,995,751 B2 2/2006 Falvo
6,996,833 B1 2/2006 Olson et al.
6,997,804 B2 2/2006 Berman
7,001,273 B2 2/2006 Baerlocher
7,033,270 B2 4/2006 Baerlocher et al.
7,037,191 B2 5/2006 Rodgers et al.
7,037,192 B2 5/2006 Baerlocher et al.
7,040,984 B2 5/2006 Mead
7,052,392 B2 5/2006 Tessmer et al.
7,056,210 B2 6/2006 Bansemer et al.
7,056,213 B2 6/2006 Ching et al.
7,056,214 B2 6/2006 Miereau et al.
7,074,127 B2 7/2006 Cuddy et al.
7,077,744 B2 7/2006 Cannon
7,090,580 B2 8/2006 Rodgers et al.
7,094,148 B2 8/2006 Baerlocher et al.
7,104,888 B2 9/2006 Miereau et al.
7,112,137 B2 9/2006 Baerlocher et al.
7,121,942 B2 10/2006 Baerlocher
7,121,943 B2 10/2006 Webb et al.
7,160,186 B2 1/2007 Cuddy et al.
7,160,188 B2 1/2007 Kaminkow et al.
7,169,041 B2 1/2007 Tessmer et al.
7,169,047 B2 1/2007 Benbrahim
7,172,506 B2 2/2007 Baerlocher et al.
7,175,523 B2 2/2007 Gilmore et al.
7,175,524 B2 2/2007 Bansemer et al.
7,182,689 B2 2/2007 Hughs-Baird et al.
7,192,344 B2 3/2007 Baerlocher
7,192,349 B2 3/2007 Baerlocher et al.
7,198,570 B2 4/2007 Rodgers et al.
7,201,657 B2 4/2007 Baerlocher et al.
7,204,259 B2 4/2007 Crisp, III
7,220,180 B2 5/2007 Kaminkow et al.
7,235,011 B2 6/2007 Randall et al.
7,264,545 B2 9/2007 Maya et al.
7,270,604 B2 9/2007 Gerrard et al.
7,273,415 B2 9/2007 Cregan et al.
7,300,348 B2 11/2007 Kaminkow et al.
7,302,650 B1 11/2007 Allyn et al.
7,303,469 B2 12/2007 Kaminkow et al.
7,311,598 B2 12/2007 Kaminkow et al.
7,311,604 B2 12/2007 Kaminkow et al.
7,314,408 B2 1/2008 Cannon
7,314,409 B2 1/2008 Maya et al.

(56) References Cited

U.S. PATENT DOCUMENTS 7,314,410 B2 1/2008 Baerlocher et al.
7,316,609 B2 1/2008 Dunn et al.
7,318,773 B2 1/2008 Baerlocher
7,326,110 B2 2/2008 Webb et al.
7,326,115 B2 2/2008 Baerlocher
7,337,864 B2 3/2008 Ruck
7,338,364 B2 3/2008 Baerlocher et al.
7,338,367 B2 3/2008 Kaminkow et al.
7,338,369 B2 3/2008 Mierau et al.
7,338,371 B2 3/2008 Cheng et al.
7,351,140 B2 4/2008 Wolf et al.
7,351,141 B2 4/2008 Rodgers et al.
7,354,344 B2 4/2008 Paulsen et al.
7,357,712 B2 4/2008 Mead et al.
7,361,087 B2 4/2008 Baerlocher et al.
7,364,507 B2 4/2008 Baerlocher et al.
7,367,883 B2 5/2008 Gagnon
7,371,166 B1 5/2008 Webb et al.
7,371,169 B2 5/2008 Baerlocher
7,371,170 B2 5/2008 Cregan et al.
7,377,849 B2 5/2008 Baerlocher et al.
7,393,280 B2 7/2008 Cannon
7,402,103 B2 7/2008 Baerlocher
7,413,510 B2 8/2008 Schlegel et al.
7,427,236 B2 9/2008 Kaminkow et al.
7,435,174 B2 10/2008 Baerlocher et al.
7,448,949 B2 11/2008 Kaminkow et al.
7,455,588 B2 11/2008 Webb et al.
7,470,184 B2 12/2008 Baerlocher et al.
7,470,187 B2 12/2008 Baerlocher et al.
7,470,188 B2 12/2008 Baerlocher et al.
7,470,189 B2 12/2008 Baerlocher et al.
7,470,190 B2 12/2008 Baerlocher et al.
7,601,057 B2 10/2009 Kaminkow
7,654,897 B2 2/2010 Devaull et al.
7,674,168 B2 3/2010 Gerrard et al.
7,722,451 B2 5/2010 Hughs-Baird et al.
7,722,463 B2 5/2010 Maya et al.
7,727,065 B2 6/2010 Seelig et al.
7,731,582 B2 6/2010 Randall et al.
7,749,070 B2 7/2010 Baerlocher et al.
7,794,316 B2 9/2010 Palmer et al.
7,841,936 B2 11/2010 Berman et al.
7,901,287 B2 3/2011 Simms et al.
7,963,842 B2 6/2011 Ruymann
8,002,620 B2 8/2011 Nicely et al.
2002/0010018 A1 1/2002 Lemay et al.
2002/0025847 A1 2/2002 Thomas et al.
2002/0034974 A1 3/2002 Wood et al.
2002/0052232 A1 5/2002 Kaminkow
2002/0077172 A1 6/2002 Uchiyama et al.
2002/0095836 A1 7/2002 Segan et al.
2002/0137559 A1 9/2002 Baerlocher et al.
2002/0155881 A1 10/2002 Yoshida
2003/0013514 A1 1/2003 Cregan et al.
2003/0027626 A1 2/2003 Marks et al.
2003/0036422 A1 2/2003 Baerlocher et al.
2003/0036424 A1 2/2003 Baerlocher
2003/0036430 A1 2/2003 Cannon
2003/0040358 A1 2/2003 Rothkranz et al.
2003/0064773 A1 4/2003 Baerlocher et al.
2003/0153378 A1 8/2003 Schlegel et al.
2003/0236115 A1 12/2003 Chamberlain
2004/0048644 A1 3/2004 Gerrard et al.
2004/0048649 A1 3/2004 Peterson et al.
2004/0048673 A1 3/2004 Kaminkow
2004/0053665 A1 3/2004 Baerlocher
2004/0087359 A1 5/2004 Cuddy et al.
2004/0097282 A1 5/2004 Baerlocher et al.
2004/0106444 A1 6/2004 Cuddy et al.
2004/0116179 A1 6/2004 Nicely et al.
2004/0242315 A1 12/2004 Paulsen et al.
2004/0248639 A1 12/2004 Slomiany
2004/0248647 A1 12/2004 Rothschild et al.
2004/0248648 A1 12/2004 Rothschild et al.
2005/0003990 A1 1/2005 Engleman et al.
2005/0020351 A1 1/2005 Baerlocher et al.
2005/0033461 A1 2/2005 Gerrard et al.
2005/0037840 A1 2/2005 Baerlocher
2005/0054404 A1 3/2005 Baerlocher
2005/0054405 A1 3/2005 Baerlocher et al.
2005/0054411 A1 3/2005 Hughs-Baird et al.
2005/0054415 A1 3/2005 Kaminkow et al.
2005/0054416 A1 3/2005 Hostetler et al.
2005/0054435 A1 3/2005 Rodgers et al.
2005/0054436 A1 3/2005 Frizzell et al.
2005/0059446 A1 3/2005 Kaminkow
2005/0059455 A1* 3/2005 Gerrard et al. ..... 463/16
2005/0059456 A1 3/2005 Mead et al.
2005/0059461 A1 3/2005 Ching et al.
2005/0064928 A1 3/2005 Baerlocher et al.
2005/0096123 A1 5/2005 Cregan et al.
2005/0101372 A1 5/2005 Mierau et al.
2005/0101375 A1 5/2005 Webb et al.
2005/0153769 A1 7/2005 Casey et al.
2005/0181860 A1 8/2005 Nguyen et al.
2005/0192081 A1 9/2005 Marks et al.
2005/0197180 A1 9/2005 Kaminkow et al.
2005/0233796 A1 10/2005 Baerlocher et al.
2006/0025196 A1 2/2006 Webb et al.
2006/0030401 A1 2/2006 Mead et al.
2006/0035706 A1 2/2006 Thomas et al.
2006/0040723 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0068882 A1 3/2006 Baerlocher et al.
2006/0073874 A1 4/2006 Cregan et al.
2006/0073877 A1 4/2006 Rodgers et al.
2006/0084494 A1 4/2006 Belger et al.
2006/0084500 A1 4/2006 Baerlocher et al.
2006/0172791 A1 8/2006 Wolf
2006/0183528 A1 8/2006 Rodgers et al.
2006/0199628 A1 9/2006 Rodgers et al.
2006/0205474 A1 9/2006 Bansemer et al.
2006/0217189 A1 9/2006 Walker et al.
2006/0246977 A1 11/2006 Cannon
2007/0015566 A1 1/2007 Baerlocher et al.
2007/0032285 A1 2/2007 Wolf
2007/0054732 A1 3/2007 Baerlocher
2007/0054733 A1 3/2007 Baerlocher
2007/0060271 A1 3/2007 Cregan et al.
2007/0060272 A1 3/2007 Webb et al.
2007/0060300 A1 3/2007 Baerlocher
2007/0077990 A1 4/2007 Cuddy et al.
2007/0082725 A1 4/2007 Low et al.
2007/0087809 A1 4/2007 Baerlocher
2007/0105620 A1 5/2007 Cuddy et al.
2007/0111783 A1 5/2007 Cuddy et al.
2007/0117606 A1 5/2007 Baerlocher et al.
2007/0129131 A1 6/2007 Kaminkow et al.
2007/0129133 A1 6/2007 Bansemer et al.
2007/0135193 A1 6/2007 Nicely
2007/0149269 A1 6/2007 Benbrahim
2007/0149270 A1 6/2007 Baerlocher et al.
2007/0149292 A1 6/2007 Kaminkow et al.
2007/0155485 A1 7/2007 Cuddy et al.
2007/0167217 A1 7/2007 Kaminkow et al.
2007/0178963 A1 8/2007 Sato
2007/0184894 A1 8/2007 Baerlocher
2007/0197276 A1 8/2007 Sato
2007/0298874 A1 12/2007 Baerlocher et al.
2007/0298875 A1 12/2007 Baerlocher et al.
2008/0004105 A1 1/2008 Cregan et al.
2008/0020817 A1 1/2008 Kaminkow et al.
2008/0020822 A1 1/2008 Cuddy et al.
2008/0020823 A1 1/2008 Cuddy et al.
2008/0020824 A1 1/2008 Cuddy et al.
2008/0020825 A1 1/2008 Cuddy et al.
2008/0020829 A1 1/2008 Baerlocher
2008/0020847 A1 1/2008 Kniesteadt et al.
2008/0026813 A1 1/2008 Cannon
2008/0032764 A1 2/2008 Cannon
2008/0032782 A1 2/2008 Boesen

(56) References Cited

U.S. PATENT DOCUMENTS

| | | | |
|---|---|---|---|
| 2008/0051168 | A1 | 2/2008 | Kaminkow et al. |
| 2008/0070676 | A1 | 3/2008 | Baerlocher et al. |
| 2008/0070677 | A1 | 3/2008 | Baerlocher et al. |
| 2008/0070678 | A1 | 3/2008 | Baerlocher et al. |
| 2008/0070702 | A1 | 3/2008 | Kaminkow et al. |
| 2008/0076514 | A1 | 3/2008 | Baerlocher et al. |
| 2008/0076515 | A1 | 3/2008 | Baerlocher et al. |
| 2008/0076517 | A1 | 3/2008 | Baerlocher et al. |
| 2008/0081690 | A1 | 4/2008 | Baerlocher et al. |
| 2008/0081691 | A1 | 4/2008 | Baerlocher et al. |
| 2008/0102920 | A1 | 5/2008 | Baerlocher |
| 2008/0108401 | A1 | 5/2008 | Baerlocher |
| 2008/0108429 | A1 | 5/2008 | Davis et al. |
| 2008/0108430 | A1 | 5/2008 | Evans |
| 2008/0108431 | A1 | 5/2008 | Cuddy et al. |
| 2008/0108436 | A1 | 5/2008 | Oberberger |
| 2008/0113765 | A1 | 5/2008 | DeWaal |
| 2008/0113768 | A1 | 5/2008 | Baerlocher |
| 2008/0113771 | A1 | 5/2008 | Baerlocher et al. |
| 2008/0113779 | A1 | 5/2008 | Cregan |
| 2008/0139274 | A1 | 6/2008 | Baerlocher |
| 2008/0139290 | A1 | 6/2008 | Kniesteadt et al. |
| 2008/0153564 | A1 | 6/2008 | Baerlocher et al. |
| 2008/0167108 | A1 | 7/2008 | Baerlocher et al. |
| 2008/0176650 | A1 | 7/2008 | Wolf et al. |
| 2008/0183535 | A1 | 7/2008 | Kahana |
| 2008/0188278 | A1 | 8/2008 | Paulsen et al. |
| 2008/0188287 | A1 | 8/2008 | Schlegel et al. |
| 2008/0200244 | A1 | 8/2008 | Rowe et al. |
| 2008/0214272 | A1 | 9/2008 | Baerlocher et al. |
| 2008/0234034 | A1 | 9/2008 | Tessmer et al. |
| 2008/0274790 | A1 | 11/2008 | Cannon |
| 2009/0088244 | A1 | 4/2009 | Nicely et al. |
| 2009/0111561 | A1 | 4/2009 | Dewaal et al. |
| 2009/0124327 | A1 | 5/2009 | Caputo et al. |
| 2009/0124362 | A1 | 5/2009 | Cuddy et al. |
| 2009/0124363 | A1 | 5/2009 | Baerlocher et al. |
| 2009/0124364 | A1 | 5/2009 | Cuddy et al. |
| 2010/0016065 | A1 | 1/2010 | Nicely et al. |
| 2010/0120498 | A1 | 5/2010 | Cuddy et al. |
| 2010/0120521 | A1 | 5/2010 | Caputo et al. |
| 2010/0261524 | A1 | 10/2010 | Pawloski et al. |
| 2011/0003627 | A1 | 1/2011 | Nicely et al. |
| 2011/0003637 | A1 | 1/2011 | LeFever |
| 2011/0053676 | A1 | 3/2011 | Wolf et al. |
| 2011/0111843 | A1 | 5/2011 | Nicely et al. |
| 2011/0118011 | A1 | 5/2011 | Filipour et al. |

FOREIGN PATENT DOCUMENTS

| | | |
|---|---|---|
| EP | 1 199 689 | 4/2002 |
| EP | 1 298 607 | 4/2003 |
| EP | 1 513 115 | 3/2005 |
| EP | 1 531 434 | 5/2005 |
| EP | 1 560 179 | 8/2005 |
| GB | 2 183 882 | 6/1987 |
| GB | 2 262 642 | 6/1993 |
| GB | 2 268 415 | 12/1994 |
| GB | 2 295 043 | 5/1996 |
| GB | 2 335 524 | 9/1999 |
| GB | 2 353 128 | 2/2001 |
| GB | 2 393 021 | 3/2004 |
| GB | 2 396 566 | 6/2004 |
| WO | WO 97/27570 | 7/1997 |
| WO | WO 00/12186 | 3/2000 |
| WO | WO 01/34261 | 5/2001 |
| WO | WO 01/74464 | 10/2001 |
| WO | WO 03/026759 | 4/2003 |
| WO | WO 03/049053 | 6/2003 |
| WO | WO 03/083795 | 10/2003 |
| WO | WO 2005/002697 | 1/2005 |
| WO | WO 2005/015826 | 2/2005 |
| WO | WO 2005/028045 | 3/2005 |
| WO | WO 2006/020811 | 2/2006 |
| WO | WO 2007/021724 | 2/2007 |

* cited by examiner

| Symbol Type | Quantity of Consecutively Accumulated | Offer Amount |
|---|---|---|
| 7 | 1 | $0.50 |
| 7 | 2 | $1.50 |
| 7 | 3 | $5.00 |
| 7 | 4 | $50.00 |
| 🍒 | 1 | $1.00 |
| 🍒 | 2 | $3.00 |
| 🍒 | 3 | $10.00 |
| 🍒 | 4 | $100.00 |
| ♡ | 1 | $2.00 |
| ♡ | 2 | $6.00 |
| ♡ | 3 | $20.00 |
| ♡ | 4 | $200.00 |

GAMING SYSTEM AND METHOD FOR PROVIDING AN OFFER AND ACCEPTANCE GAME

CROSS REFERENCE TO RELATED APPLICATIONS

This application relates to the following commonly owned patent applications: "GAMING SYSTEM AND METHOD FOR PROVIDING AN OFFER AND ACCEPTANCE GAME" Ser. No. 13/626,334.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

One such type of secondary or bonus game is an offer and acceptance game which enables players to accept or decline multiple award offers. One such gaming device provides the player with a quantity of offers and a final award. When an offer is given, the player may accept or reject the offer. If the player accepts an offer, the player receives the accepted offer amount and the bonus game terminates. If the player declines an offer, the game generates another offer for the player. The player is automatically provided with the last selected offer if the player rejects each of the quantity of previous offers. In this known offer/acceptance game, when the player rejects an offer, the player risks a current or guaranteed award for a higher value award. The game may instead provide a lower award. The game thus creates a risk for the player.

Enabling a player to pick from different risk based alternatives and then enabling the player to accumulate awards or offers from the selected alternatives provides excitement and enjoyment to the player. A continuing need exists to provide offer/acceptance games that enable a player to weigh options and explore the consequences of selecting those options where the player may accumulate awards or offers.

SUMMARY

The present disclosure relates generally to gaming systems and methods for providing an offer and acceptance game.

In various embodiments, the offer and acceptance game disclosed herein includes a series of offer component accumulations. One or more accumulated offer components are associated with one or more award values which form different offers for acceptance or rejection. In these embodiments, one or more of such offer component accumulations are also associated with an elimination of one or more of any previously accumulated offer components. Such a configuration provides that when deciding whether to accept an offer (including the currently accumulated, non-eliminated offer components) or reject the offer and accumulate additional offer components, a player weighs the risks of eliminating one or more previously accumulated offer components. Accordingly, the gaming system of these embodiments enables the player to make one or more decisions to: (i) accept a known award offer (formed from any previously accumulated offer components) and forfeit the opportunity to accumulate any additional award offers, or (ii) risk the known award offer for an opportunity to accumulate additional offer components for a greater award offer (and potentially forfeit any previously accumulated offer components).

In certain embodiments, upon an occurrence of an offer and acceptance game triggering event, the gaming system accumulates offer components in unoccupied offer component positions of one or more offer component position sets. In these embodiments, the gaming system forms one or more offers for the player to accept or reject based on the non-eliminated offer components which currently occupy the offer component positions of the offer component position sets. In these embodiments, upon an occurrence of an offer component position set elimination event, the gaming system eliminates one or more previously accumulated offer components of the eliminated offer component position set, wherein such eliminated offer components are excluded from any subsequently formed offers. Accordingly, the gaming system of this embodiment enables the player to proceed with the random assignment of offer components to offer component positions of offer component position sets wherein one or more of such random assignments are associated with the elimination of previously accumulated offer components.

In one such embodiment, the gaming system displays a plurality of offer component position sets, each offer component position set including a plurality of offer component positions, and randomly assigns at least one offer component to at least one of the offer component position sets, wherein each randomly assigned offer component is associated with one of a plurality of different award values and occupies one of the offer component positions of one of the offer component position sets. The gaming system repeats these random assignments until each of the offer component positions of at least one of the offer component position sets are occupied with offer components and then enables a player to accept or reject a first offer based on the award values associated with the offer components occupying the offer component positions of the offer component position sets. If the player accepts the first offer, the gaming system provide the player the accepted first offer. If the player rejects the first offer, the gaming system, for each of at least one offer component, randomly selects one of the offer component position sets. If the selected offer component position set includes at least one unoccupied offer component position, the gaming system assigns the offer component to the selected offer component position set. If each of the offer component positions of the selected offer component position set are occupied with offer components, the gaming system eliminates the selected offer component position set. The gaming system of this embodiment also enables the player to accept or reject a second offer based on the award values associated with the offer components occupying the offer component positions of the non-eliminated offer component position sets.

In certain embodiments, the offer and acceptance game is a persistence game which occurs over a plurality of plays of the primary game. In these embodiments, the gaming system accumulates offer components in the form of generated primary game symbols. The gaming system first determines which primary game symbols are accumulated and how many matching or otherwise related primary game symbols are consecutively accumulated and then forms an offer for the player to accept or reject based on these determinations. In at least one embodiment, different quantities of accumulated primary game symbols are associated with different award values which the gaming system offers to the player to accept or reject. For example, a first quantity of a first accumulated primary game symbol is associated with a first award value (which forms a first offer for the player to accept or reject) and a second, different quantity of the first accumulated primary game symbol is associated with a second, different award value (which forms a second offer for the player to accept or reject). In at least another embodiment, different accumulated primary game symbols are associated with different award values which the gaming system offers to the player to accept or reject. For example, a first quantity of a first accumulated primary game symbol is associated with a first award value (which forms a first offer for the player to accept or reject) and the first quantity of a second accumulated primary game symbol is associated with a second, different award value (which forms a second offer for the player to accept or reject). In these embodiments, as the gaming system determines each offer based on the quantity of matching or otherwise related primary game symbols which are consecutively accumulated, each time the player rejects an offer, the player risks that the next primary game symbol accumulated will not match or otherwise be related to the previously accumulated primary game symbols. Thus, the player risks that the previously accumulated primary game symbols will be eliminated. Accordingly, these embodiments employ an element of strategy or skill as the player continuously weighs different options available and how such different options affect the offers available to the player.

In one such embodiment, the gaming system displays an offer component position set in association with a persistent offer and acceptance game, the offer component position set including a plurality of offer component positions. For a play of a primary game in association with a placement of a wager, the gaming system randomly generates a plurality of symbols, displays the generated symbols, determines any award associated with the generated symbols, and displays any determined award. If at least one of the generated symbols is one of a plurality of different designated symbols and the designated symbol is not associated with any of at least one symbol which occupies at least one of the offer component positions of the offer component position set, the gaming system eliminates the symbols which occupy the offer component positions of the offer component position set, and assigns the designated symbol to at least one of the offer component positions of the offer component position set. If no symbols occupy any of the offer component positions of the offer component position set or at least one of the generated symbols is one of the plurality of different designated symbols and the designated symbol is associated with each of the symbols which occupy each of the offer component positions of the offer component position set, the gaming system assigns the designated symbol to at least one of the offer component positions of the offer component position set. The gaming system then forms an award offer based on the symbols assigned to the offer component positions of the offer component position set and enables a player to accept or reject the formed award offer. If the player accepts the formed award offer, the gaming system provides the player the accepted award offer. If the player rejects the formed award offer, the gaming system proceeds as described above for another placement of another wager.

The offer and acceptance games disclosed herein thus provide that certain players will account for different variables (and in certain instances, different competing variables) when determining whether to accept or reject each offer. Accordingly, the gaming system described herein provides an interesting and exciting offer and acceptance game for players wherein the player's individual decisions regarding accepting or rejecting each offer affect the total award amount provided to the player in association with such offer and acceptance games.

Additional features and advantages are described in, and will be apparent from, the following Detailed Description and the figures.

DETAILED DESCRIPTION

Offer and Acceptance Game

In various embodiments, the offer and acceptance game disclosed herein includes a series of offer component accumulations. One or more accumulated offer components are associated with one or more award values which form different offers for acceptance or rejection. In these embodiments, one or more of such offer component accumulations are also associated with an elimination of one or more of any previously accumulated offer components. Such a configuration provides that when deciding whether to accept an offer (including the currently accumulated, non-eliminated offer components) or reject the offer and accumulate additional offer components, a player weighs the risks of eliminating one or more previously accumulated offer components. Accordingly, the gaming system of these embodiments enables the player to make one or more decisions to: (i) accept a known award offer (formed from any previously accumulated offer components) and forfeit the opportunity to accumulate any additional award offers, or (ii) risk the known award offer for an opportunity to accumulate additional offer components for a greater award offer (and potentially forfeit any previously accumulated offer components).

While certain of the embodiments described below are directed to a secondary or bonus game, it should be appreciated that the present disclosure may additionally or alternatively be employed in association with a primary or base wagering game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
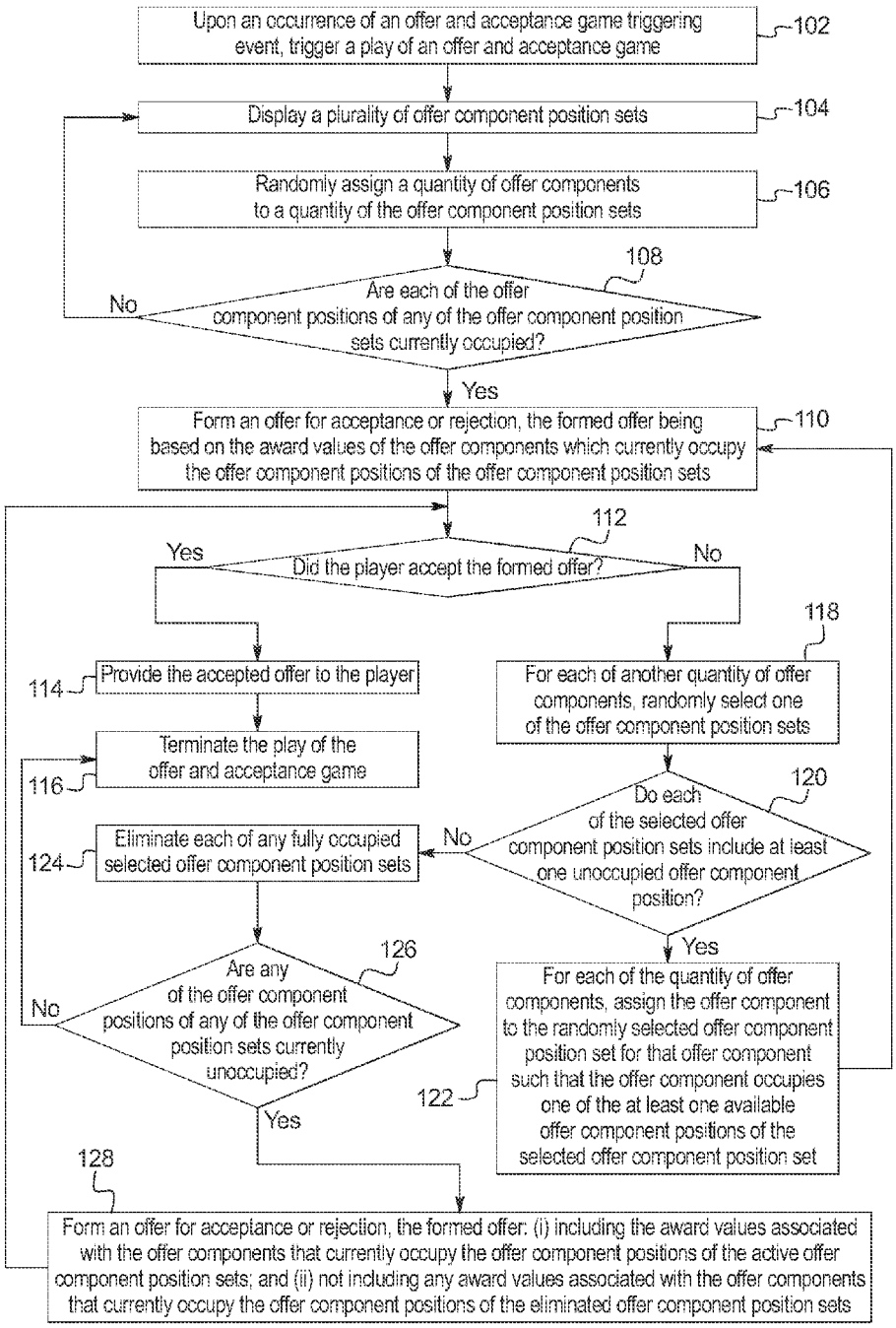
FIG. 1 is a flow chart an example process for operating a gaming system providing one embodiment of an offer and acceptance game disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, upon an occurrence of an offer and acceptance game triggering event, as indicated in block 102 of FIG. 1, the gaming system triggers a play of an offer and acceptance game. In one embodiment, the offer and acceptance game is a secondary or bonus game wherein an offer and acceptance game triggering event occurs based on a displayed event associated with a wagered on play of a primary game. In another such embodiment wherein the offer and acceptance game is a secondary or bonus game, an offer and acceptance game triggering event occurs based on an event independent of any displayed event associated with a wagered on play of a primary game. In another such embodiment, the offer and acceptance game is a primary game wherein an offer and acceptance game triggering event occurs upon a player placing a wager to play the offer and acceptance game.

In one embodiment, for the triggered offer and acceptance game, the gaming system displays a plurality of offer component position sets or groups as indicated in block 104. Each offer component position set includes a plurality of offer component positions. As described below, each offer component position is configured to accumulate, be occupied by or otherwise house at least one offer component, such as one of a plurality of different offer component award values.

Figure 2A:
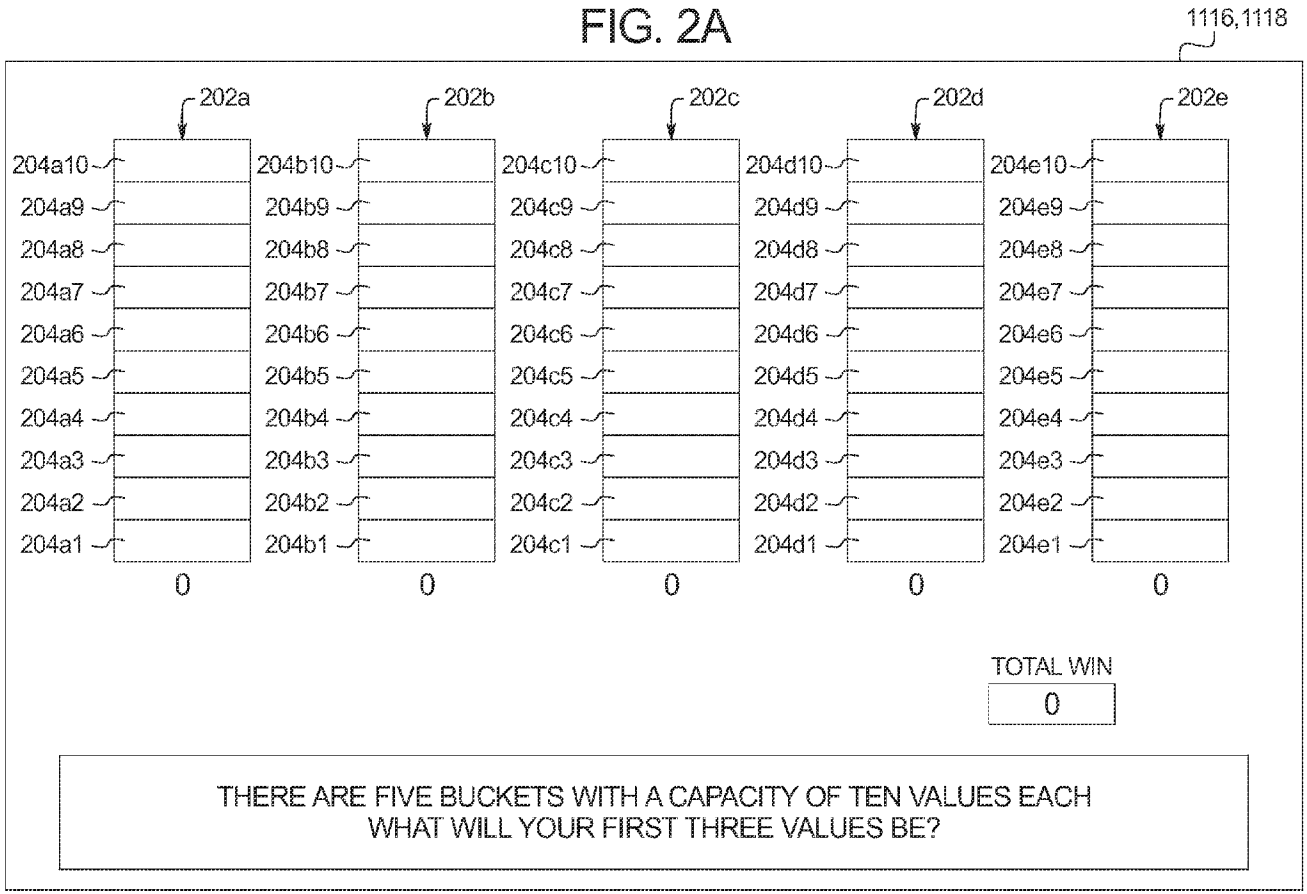
FIGS. 2A, 2B, 2C, 2D, 2E, 2F and 2G are front views of one embodiment of the gaming system disclosed herein illustrating an offer and acceptance game including a plurality of offer component position sets.

For example, as seen in FIG. 2A, for the triggered offer and acceptance game, the gaming system displays five offer component position sets 202*a*, 202*b*, 202*c*, 202*d* and 202*e*. In this example, each offer component position set includes ten offer component positions 204. Specifically: (i) offer component position set 202*a* includes offer component positions 204*a*1 to 204*a*10; (ii) offer component position set 202*b* includes offer component positions 204*b*1 to 204*b*10; (iii) offer component position set 202*c* includes offer component positions 204*c*1 to 204*c*10; (iv) offer component position set 202*d* includes offer component positions 204*d*1 to 204*d*10; and (v) offer component position set 202*e* includes offer component positions 204*e*1 to 204*e*10. In this example, the gaming system provides appropriate messages such as "THERE ARE FIVE BUCKETS WITH A CAPACITY OF TEN VALUES EACH" and "WHAT WILL YOUR FIRST THREE VALUES BE?" to the player visually, or through suitable audio or audiovisual displays.

After displaying the plurality of offer component position sets, the gaming system randomly assigns a quantity of offer components to a quantity of the offer component position sets as indicated in block 106 of FIG. 1. Each offer component assigned to an offer component position set occupies one of any unoccupied offer component positions of that offer component set. Additionally, each offer component has, corresponds to or is otherwise associated with an award value, such as an amount of monetary credits or an amount of non-monetary credits.

Figure 2B:
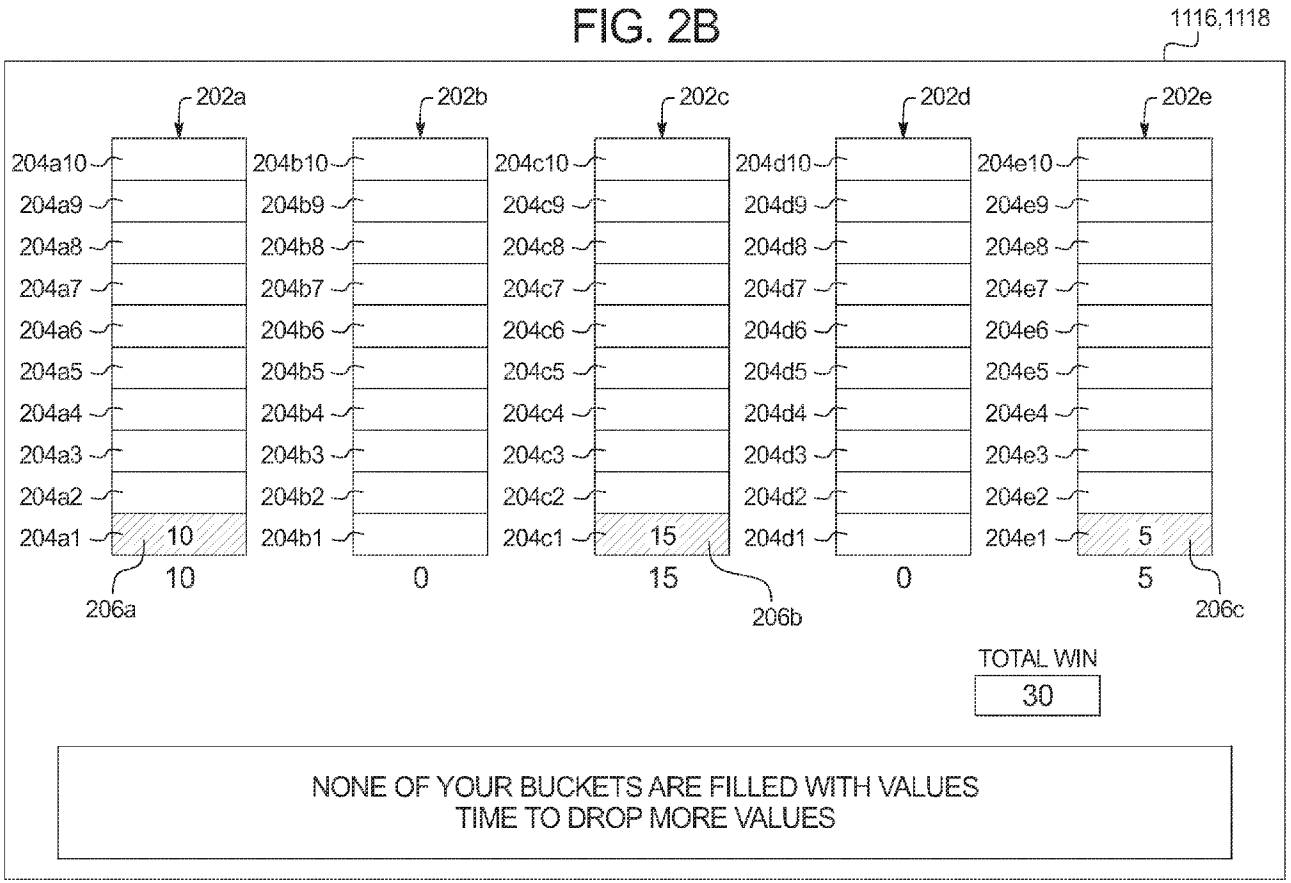

For example, as seen in FIG. 2B, the gaming system randomly assigns three offer components 206 to three of the offer component position sets 202, wherein each offer component occupies one of the unoccupied offer component positions 204 of the offer component position set which that offer component is assigned. Specifically, the gaming system randomly assigns: (i) offer component 206*a* (having an award value of ten credits) to offer component position set 202*a*; (ii) offer component 206*b* (having an award value of fifteen credits) to offer component position set 202*c*; and (iii) offer component 206*c* (having an award value of five credits) to offer component position set 202*e*. As further seen in FIG. 2B, such assignment of the offer components to the offer component position sets causes: (i) offer component 206*a* to occupy offer component position 204*a*1 of offer component position set 202*a*; (ii) offer component 206*c* to occupy offer component position 204*c*1 of offer component position set 202*c*; and (iii) offer component 206*c* to occupy offer component position 204*e*1 of offer component position set 202*e*. It should be appreciated that in certain embodiments each single offer component occupies or is otherwise assigned to a single offer component position of a single offer component position set regardless of an amount or value of such an offer component.

After assigning one or more offer components to one or more offer component positions of one or more offer component position sets, the gaming system determines if each of the offer component positions of any of the offer component position sets are currently occupied as indicated in diamond 108 of FIG. 1. That is, after causing one or more offer components to occupy one or more of the offer component positions, the gaming system determines if any of the offer component position sets has reached an accumulation capacity of offer components. Put differently, the gaming system determines whether each of the offer component sets includes at least one unoccupied offer component position.

If each of the offer component position sets includes at least one unoccupied offer component position, the gaming system returns to block 106 and randomly assigns another quantity of offer components to another quantity of the offer component position sets. In other words, if none of the offer component position sets have reached accumulation capacity of offer components, the gaming system continues with causing offer components to occupy the previously unoccupied offer component positions of the offer component position sets.

Referring back to FIG. 2B, after determining that none of the offer component sets 202 are fully occupied with assigned offer components, the gaming system determines to again randomly assign offer components to the offer component position sets. In this example, the gaming system provides appropriate messages such as "NONE OF YOUR BUCKETS ARE FILLED WITH VALUES" and "TIME TO DROP MORE VALUES" to the player visually, or through suitable audio or audiovisual displays.

Figure 2C:
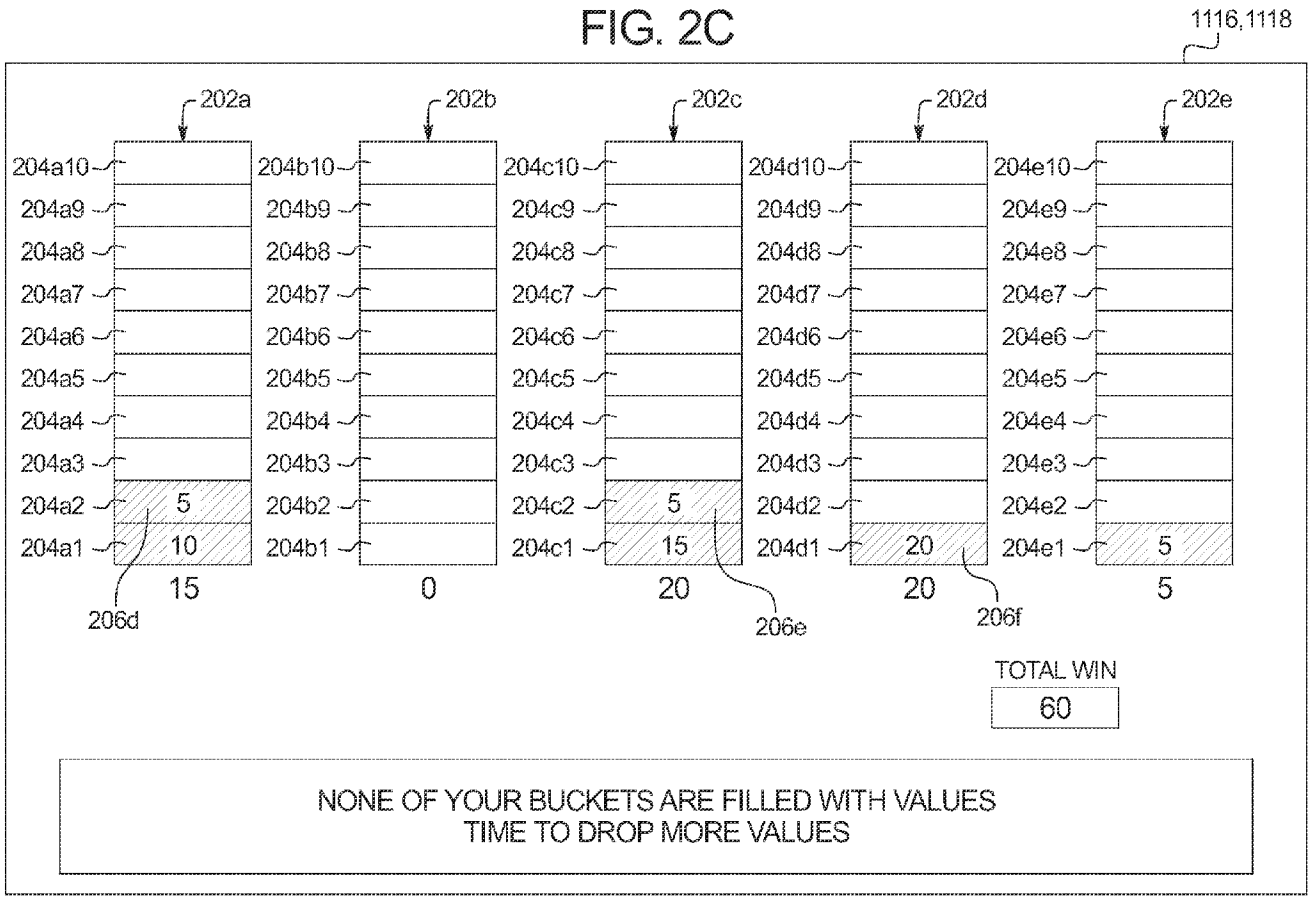

As seen in FIG. 2C, for the next random assignment of offer components, the gaming system randomly assigns three more offer components 206 to three of the offer component position sets 202, wherein each offer component occupies one of the unoccupied offer component positions 204 of the offer component position set which that offer component is assigned. Specifically, the gaming system randomly assigns: (i) offer component 206*d* (having an award value of five credits) to offer component position set 202*a*; (ii) offer component 206*e* (having an award value of five credits) to offer component position set 202*c*; and (iii) offer component 206*f* (having an award value of twenty credits) to offer component position set 202*d*. As further seen in FIG. 2C, such assignment of the offer components to the offer component position sets causes: (i) offer component 206*d* to occupy offer component position 204*a*2 of offer component position set 202*a*; (ii) offer component 206*e* to occupy offer component position 204*c*2 of offer component position set 202*c*; and (iii) offer component 206*f* to occupy offer component position 204*d*1 of offer component position set 202*d*. In this example, the gaming system provides appropriate messages such as "NONE OF YOUR BUCKETS ARE FILLED WITH VALUES" and "TIME TO DROP MORE VALUES" to the player visually, or through suitable audio or audiovisual displays.

Returning to FIG. 1, if the gaming system determines that each of the offer component positions of at least one of the offer component position sets are currently occupied, as indicated in block 110, the gaming system forms an offer for acceptance or rejection. As also indicated in block 110, the formed offer includes the award values associated with the offer components that currently occupy the offer component positions of the offer component position sets. In these embodiments, the gaming system determines an offer based on the award values of the offer components currently accumulated in the offer component position sets. Accordingly, the gaming system of these embodiments accumulates offer components of different award values until such accumulation causes a complete offer formation event to occur (at which point in time the gaming system offers such accumulated award values to the player to accept or reject).

Following the formation of an offer, the gaming system determines if the player accepted (or rejected) the formed offer as indicated in diamond 112.

Figure 2D:
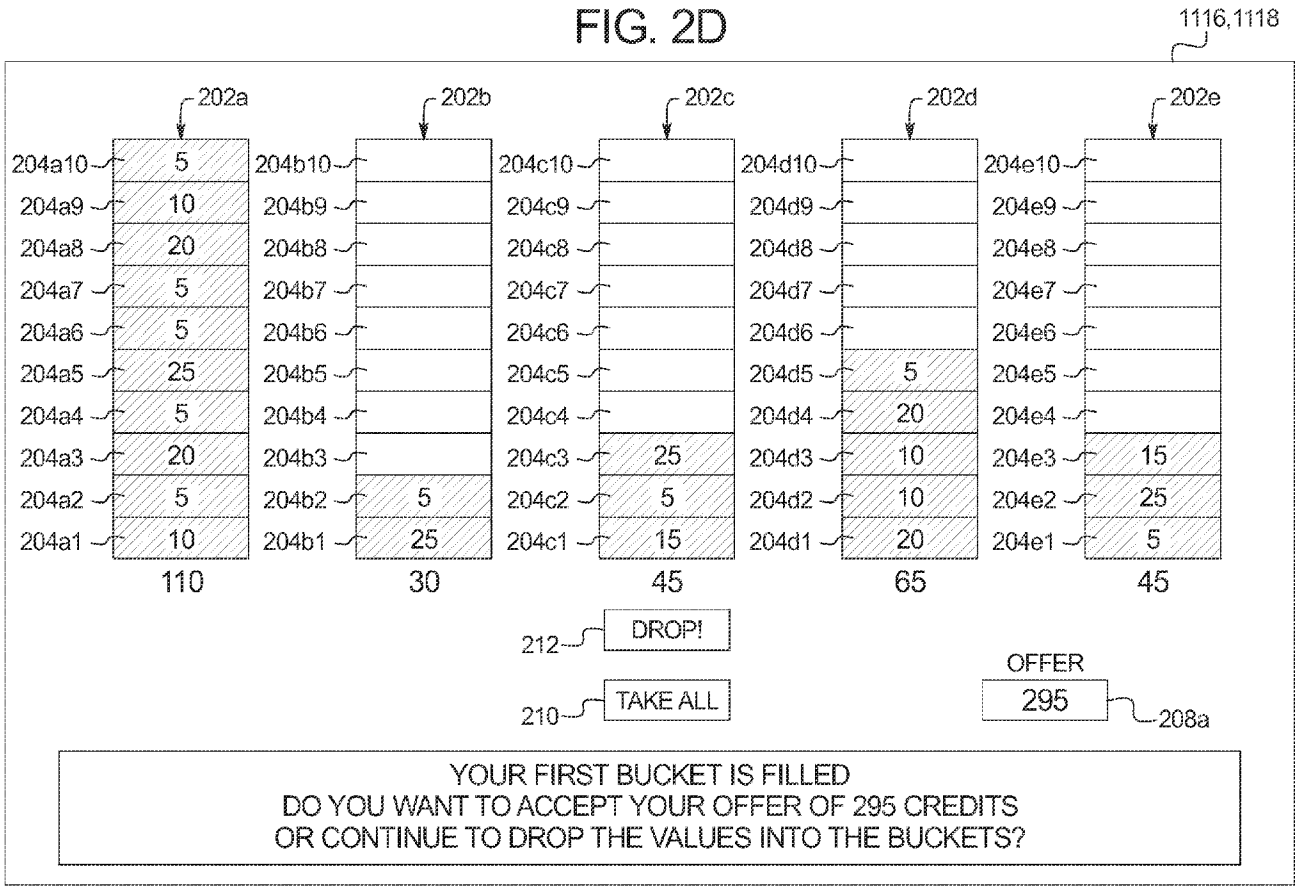

As seen in FIG. 2D, following several additional random assignment of offer components to previously unoccupied offer component positions of the offer component position sets, the gaming system determines that each of the offer component positions 204*a*1 to 204*a*10 of offer component position set 202*a* are assigned an offer component 206 (i.e., offer component position set 202*a* is completely occupied with offer components). At this point, the gaming system forms an offer of two-hundred-ninety-five credits 208*a*. This offer includes: (i) the award values totaling one-hundred-ten credits associated with each of the offer components that currently occupy offer component positions 204*a*1 to 204*a*10 of offer component position set 202*a*; (ii) the award values totaling thirty credits associated with each of the offer components that currently occupy offer component positions 204*b*1 to 204*b*2 of offer component position set 202*b*; (iii) the award values totaling forty-five credits associated with each of the offer components that currently occupy offer component positions 204*c*1 to 204*c*3 of offer component position set 202*c*; (vi) the award values totaling sixty-five credits associated with each of the offer components that currently occupy offer component positions 204*d*1 to 204*d*5 of offer component position set 202*d*; and (v) the award values totaling forty-five credits associated with each of the offer components that currently occupy offer component positions 204*e*1 to 204*e*3 of offer component position set 202*e*.

As further seen in FIG. 2D, the gaming system enables the player to accept this formed offer using an accept offer input 210 or reject this formed offer using a reject offer input 212. In this example, the gaming system provides appropriate messages such as "YOUR FIRST BUCKET IS FILLED", and "DO YOU WANT TO ACCEPT YOUR OFFER OF 295 CREDITS OR CONTINUE TO DROP THE VALUES INTO THE BUCKETS?" to the player visually, or through suitable audio or audiovisual displays.

If the player accepts the formed offer, as indicated in blocks 114 and 116 of FIG. 1, the gaming system provides the accepted offer to the player and terminates the play of the offer and acceptance game. In these embodiments, by accepting the formed offer, the player accepts a known award (formed from the award values of any previously accumulated offer components) while forfeiting the opportunity to accumulate any additional award values of any subsequently accumulated offer components.

On the other hand, if the player rejects the offer, the gaming system continues assigning offer components to the offer components sets. Put differently, if the player decides to risk a current offer for a chance at a subsequent offer of greater value, the gaming system attempts to randomly assign another quantity of offer components to another quantity of the offer component position sets. Specifically, if the player rejects (i.e., does not accept) the formed offer, for each of another quantity of offer components, the gaming system randomly selects one of the offer component position sets as indicated in block 118. The gaming system then determines if each of the selected offer component position sets includes at least one unoccupied offer component position as indicated in diamond 120.

If the gaming system determines that each of the selected offer component position sets includes at least one unoccupied offer component position to house one of the quantity of offer components, as indicated in block 122, for each of this quantity of offer components, the gaming system assigns the offer component to the randomly selected offer component position set for that offer component. Following such an assignment, the offer component occupies one of the at least one available offer component positions of the selected offer component position set. Following this assignment of these offer components to the offer component positions of the selected offer component position sets, the gaming system returns to block 110 and forms another offer. As described above, this formed offer includes the award values associated with the offer components that currently occupy the offer component positions of the offer component position sets.

On the other hand, if the gaming system determines that each of the offer component positions of at least one of the selected offer component position sets are occupied with previously assigned offer components, the gaming system eliminates each of such fully occupied selected offer component position sets as indicated in block 124. Put differently, if the gaming system selects an offer component position set to add another offer component and the selected offer component position set is already at full capacity of occupied offer component positions (i.e., each offer component position of the selected offer component position set is already assigned an offer component), the gaming system nullifies, deactivates or otherwise flags as unavailable each of the previously assigned offer components of the selected offer component position set. In other words, if the player attempts to increase a previous offer by causing one or more additional offer components to be placed in one or more different offer component positions and at least one of the additional offer components cannot be placed in such any offer component positions of an offer component position set, the gaming system causes the award values of the offer components of such an offer component position set not to be included in any subsequently formed offers.

Following such elimination of any selected offer component position sets which the gaming system is unable to assign any additional offer components to, the gaming system determines if any of the offer component positions of any of the offer component position sets are currently unoccupied as indicated in diamond 126. That is, the gaming system determines if any offer component positions remain available to assign any subsequent offer components.

If each of the offer component positions of each of the offer component position sets are occupied with previously assigned offer components, the gaming system terminates the play of the offer and acceptance game as indicated in block 116. In other words, if each of the offer component positions are occupied, there is nowhere for the gaming system to place any additional offer components and the gaming system ends the play of the offer and acceptance game. It should be appreciated that in certain embodiments, the gaming system terminates the play of the offer and acceptance game without providing the player any award (or providing the player a consolation award) In this embodiments, the player's decision to reject a previous known offer in an attempt to obtain a subsequent, more lucrative offer resulted in the player not winning any awards (or winning a less-lucrative consolation award).

On the other hand, if at least one of the offer component positions of at least one of the offer component position sets is currently unoccupied, as indicated in block 128, the gaming system forms another offer for acceptance or rejection. As further indicated in block 128, this formed offer: (i) includes the award values associated with the offer components that currently occupy the offer component positions of the active offer component position sets; and (ii) does not include any award values associated with the offer components that currently occupy the offer component positions of the eliminated offer component position sets.

Following the formation of this offer, the gaming system returns to diamond 112 and determines if the player accepted (or rejected) the formed offer. As described above, if the player accepts this new formed offer, the gaming system provides the accepted offer to the player and terminates the play of the offer and acceptance game. As also described above, if the player rejects this formed offer, the gaming system attempts to randomly assign another quantity of offer components to another quantity of the offer component position sets. This process continues until either the player accepts an offer or each of the offer component positions are eliminated (i.e., each of the offer component positions of each of the offer component sets includes an offer component).

Figure 2E:
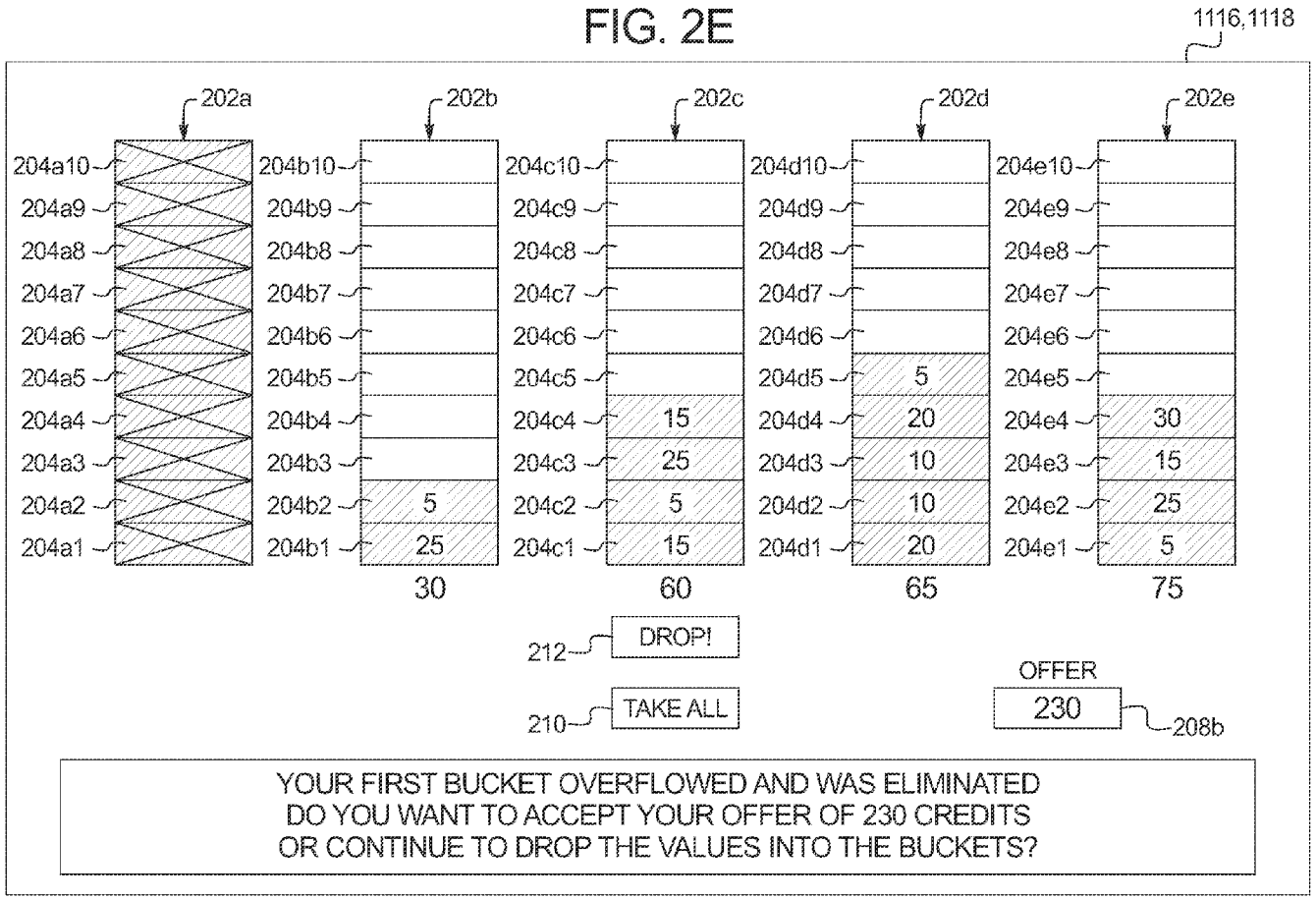

Continuing with the above-described example, as seen in FIG. 2E, after the player rejected the offer of two-hundred-ninety five credits (from FIG. 2D), the gaming system attempted to randomly assign three more offer components 206 to three of the offer component position sets 202. In this example, while the gaming system successfully assigned two of these offer components to two of the offer component position sets (i.e., an offer component 206 having an award value of fifteen credits was successfully assigned to offer component position 204*c*4 of offer component position set 202*c* and an offer component 206 having an award value of thirty credits was successfully assigned to offer component position 204*e*4 of offer component position set 202*e*), the gaming system unsuccessfully assigned the third offer component to any offer component positions of offer component position set 202*a*. Accordingly, the gaming system eliminated offer component position set 202*a* and thus eliminated each of the offer components which occupied the offer component positions of offer component position set 202*a*.

As also seen in FIG. 2E, following this elimination of offer component position set 202*a*, the gaming system forms an offer of two-hundred-thirty credits 208*b*. This offer includes: (i) the award values totaling thirty credits associated with each of the offer components that currently occupy offer component positions 204*b*1 to 204*b*2 of offer component position set 202*b*; (ii) the award values totaling sixty credits associated with each of the offer components that currently occupy offer component positions 204*c*1 to 204*c*4 of offer component position set 202*c*; (iii) the award values totaling sixty-five credits associated with each of the offer components that currently occupy offer component positions 204*d*1 to 204*d*5 of offer component position set 202*d*; and (iv) the award values totaling seventy-five credits associated with each of the offer components that currently occupy offer component positions 204*e*1 to 204*e*4 of offer component position set 202*e*. As seen in this example, since offer component position set is eliminated, none of the award values which occupied any of the offer component positions 204*a*1 to 204*a*10 of offer component position set are included in this offer.

As further seen in FIG. 2E, the gaming system enables the player to accept this formed offer using an accept offer input 210 or reject this formed offer using a reject offer input 212. In this example, the gaming system provides appropriate messages such as "YOUR FIRST BUCKET OVERFLOWED AND WAS ELIMINATED", and "DO YOU WANT TO ACCEPT YOUR OFFER OF 230 CREDITS OR CONTINUE TO DROP THE VALUES INTO THE BUCKETS?" to the player visually, or through suitable audio or audiovisual displays.

Figure 2F:
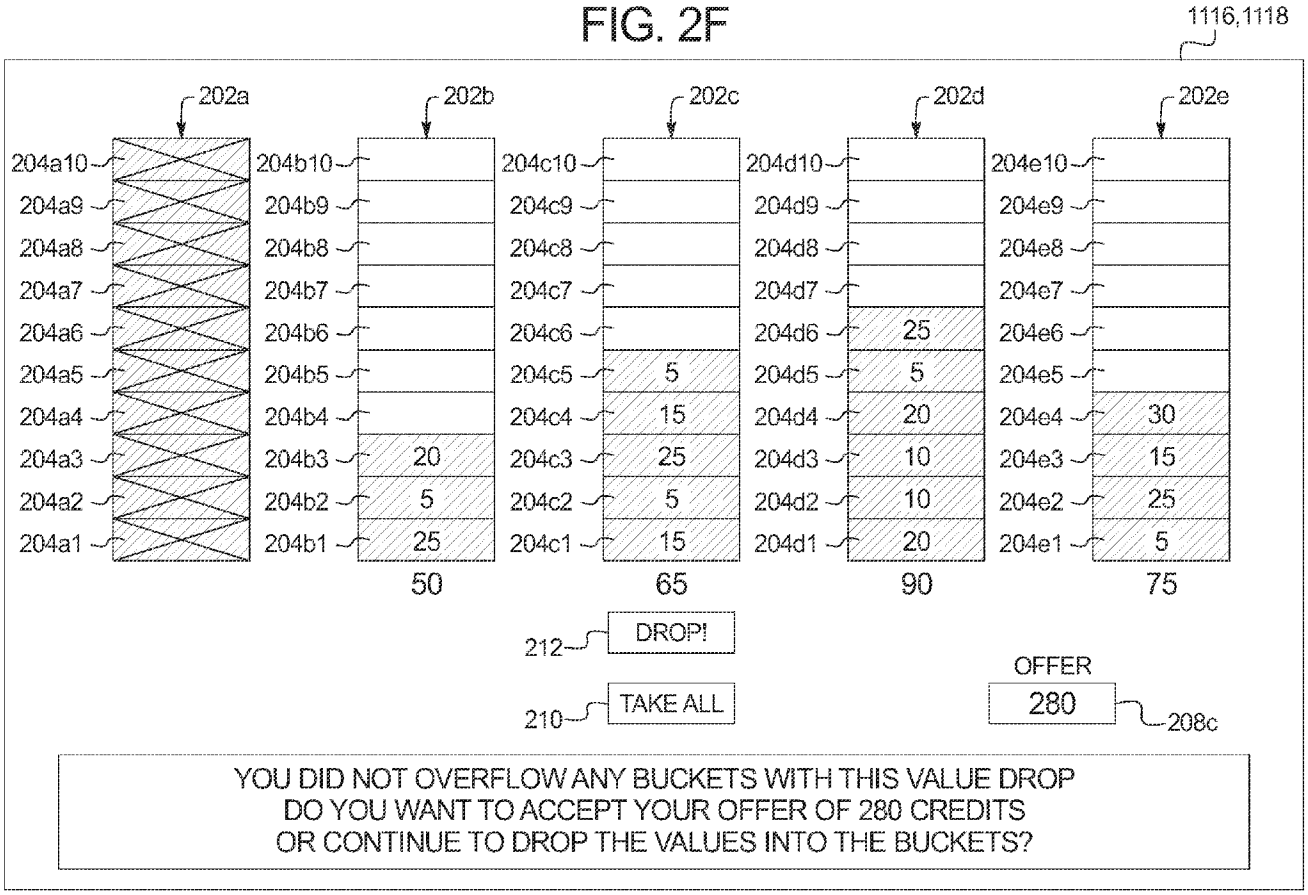

As seen in FIG. 2F, the player elected to reject the offer of two-hundred-thirty credits and the gaming system attempted to randomly assign three more offer components 206 to three of the non-eliminated offer component position sets 202. In this example, the gaming system successfully assigned each of the three offer components to the offer component position sets and the gaming system formed an offer of two-hundred-eighty credits 208*c*. This offer includes: (i) the award values totaling fifty credits associated with each of the offer components that currently occupy offer component positions 204*b*1 to 204*b*3 of offer component position set 202*b*; (ii) the award values totaling sixty-five credits associated with each of the offer components that currently occupy offer component positions 204*c*1 to 204*c*5 of offer component position set 202*c*; (iii) the award values totaling ninety credits associated with each of the offer components that currently occupy offer component positions 204*d*1 to 204*d*6 of offer component position set 202*d*; and (iv) the award values totaling seventy-five credits associated with each of the offer components that currently occupy offer component positions 204*e*1 to 204*e*4 of offer component position set 202*e*. As seen in this example, since offer component position set is eliminated, none of the award values which occupied any of the offer component positions 204*a*1 to 204*a*10 of offer component position set are included in this offer.

As further seen in FIG. 2F, the gaming system enables the player to accept this formed offer using an accept offer input 210 or reject this formed offer using a reject offer input 212. In this example, the gaming system provides appropriate messages such as "YOU DID NOT OVERFLOW ANY BUCKETS WITH THIS VALUE DROP", and "DO YOU WANT TO ACCEPT YOUR OFFER OF 280 CREDITS OR CONTINUE TO DROP THE VALUES INTO THE BUCKETS?" to the player visually, or through suitable audio or audiovisual displays.

Figure 2G:
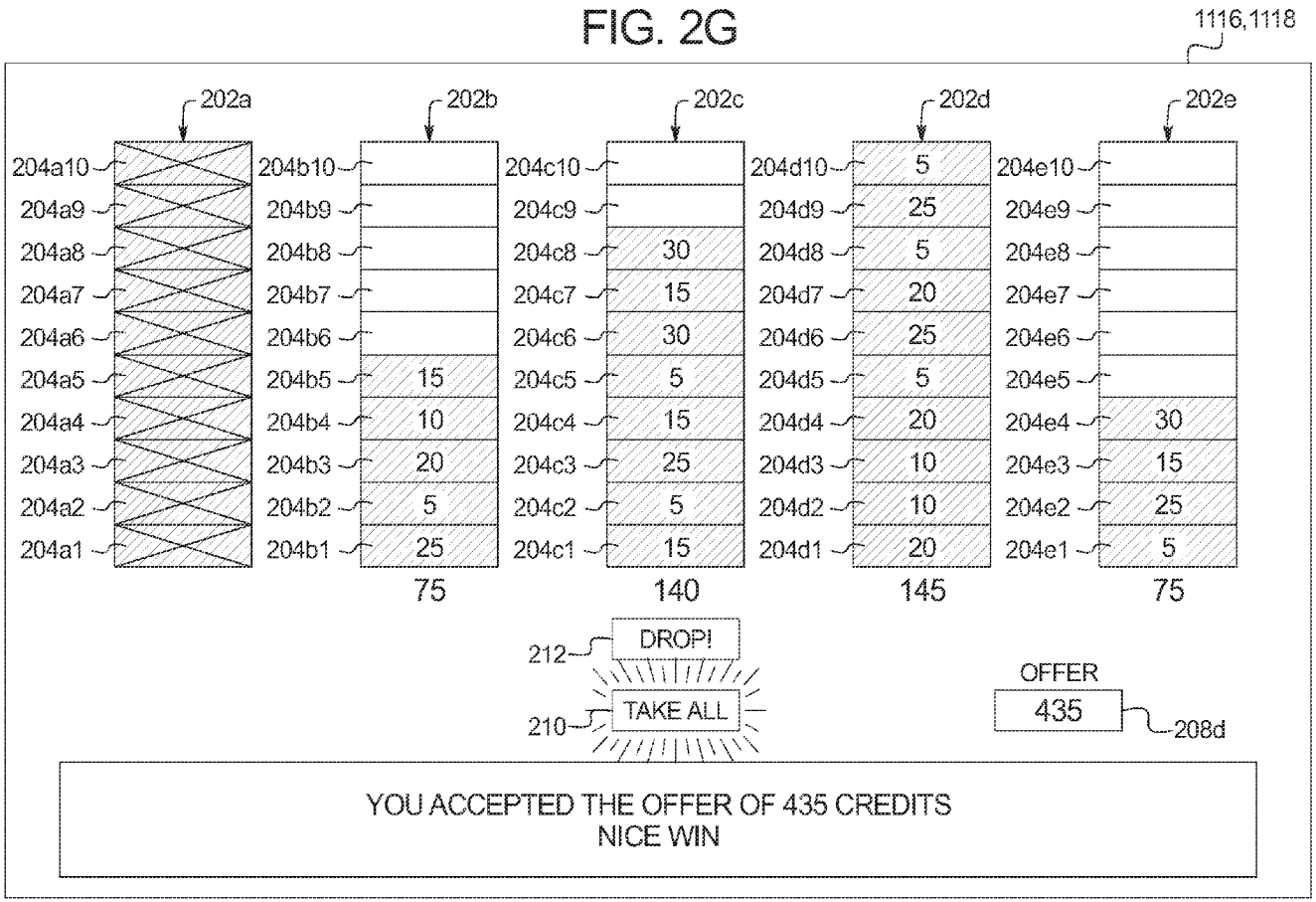

As seen in FIG. 2G, following several rejections of subsequent offers and several assignment of offer components to available offer component positions of offer component position sets, the gaming system formed an offer of four-hundred-thirty-five credits 208*d*. This offer includes: (i) the award values totaling seventy-five credits associated with each of the offer components that currently occupy offer component positions 204*b*1 to 204*bd* of offer component position set 202*b*; (ii) the award values totaling one-hundred-forty credits associated with each of the offer components that currently occupy offer component positions 204*c*1 to 204*c*8 of offer component position set 202*c*; (iii) the award values totaling one-hundred-forty-five credits associated with each of the offer components that currently occupy offer component positions 204*d*1 to 204*d*10 of offer component position set 202*d*; and (iv) the award values totaling seventy-five credits associated with each of the offer components that currently occupy offer component positions 204*e*1 to 204*e*4 of offer component position set 202*e*. As seen in this example, since offer component position set is eliminated, none of the award values which occupied any of the offer component positions 204*a*1 to 204*a*10 of offer component position set are included in this offer.

In this example, as seen in FIG. 2G, since each of the offer component positions of offer component position set 202*d* are occupied, rather than risk eliminating the offer components of offer component position set 202*d*, the player elected to accept the offer of four-hundred-thirty-five credits. Accordingly, the gaming system provided the player a total award of four-hundred-thirty-five credits and terminated the play of the offer and acceptance game. In this example, the gaming system provides appropriate messages such as "YOU ACCEPTED THE OFFER OF 435 CREDITS" and "NICE WIN" to the player visually, or through suitable audio or audiovisual displays.

In one embodiment, as seen in FIGS. 2A to 2G, the quantity of offer component positions in each offer component position set is the same. In another embodiment, the quantity of offer component positions in each of a plurality of the offer component position sets are different. In another embodiment, the quantity of offer components positions in each offer component position sets are different.

In one embodiment, the quantity of offer components the gaming system attempts to assign to offer component positions is the same for each random assignment of offer components to offer component positions. In another embodiment, the quantity of offer components the gaming system attempts to assign to offer component positions is different for each of a plurality of random assignments of offer components to offer component positions. In another embodiment, the quantity of offer components the gaming system attempts to assign to offer component positions is different for each random assignment of offer components to offer component positions.

In one such embodiment wherein different quantities of offer components are assigned to offer component positions for at least two random assignments of offer components to offer component positions, the quantity of offer components the gaming system attempts to assign to offer component positions for each random assignment of offer components is equal to the number of offer component position sets with at least one available or unoccupied offer component position. For example, if a play of the game initially includes five offer component position sets, the gaming system randomly assigns five offer components until each of the offer component positions of at least one offer component position set are occupied. In this example, after eliminating one offer component position set such that four offer component positions sets remain, for at least the next random assignment of offer components, the gaming system randomly assigns four offer components.

In another such embodiment wherein different quantities of offer components are assigned to offer component positions for at least two random assignments of offer components to offer component positions, the gaming system displays to the player the quantity of offer components which will be attempted to be assigned for the next random assignment of offer components. In this embodiment, such previewed information regarding the next quantity of offer components may factor into a player's decision to accept or reject a current offer. For example, if the player knows only one more offer component will be attempted to be assigned to an offer component position for the next assignment of offer components, the player may decide to reject the current offer. On the other hand, if the player knows ten more offer components will be attempted to be assigned to offer component positions for the next assignment of offer components, the player may not want to risk eliminating any offer component sets and thus the player will accept the current offer.

In one embodiment, for a random assignment of offer components to offer component positions, the value or amount of each assigned offer component is the same. In another embodiment, for a random assignment of offer components to offer component positions, the value or amount of each of a plurality of the assigned offer component is different. In another embodiments, for a random assignment of offer components to offer component positions, the value or amount of each assigned offer component is different.

In one embodiment, for each random assignment of offer components to offer component positions, the value or amount of each assigned offer component is the same. In another embodiment, for each random assignment of offer components to offer component positions, the value or amount of each of a plurality of the assigned offer component is different. In another embodiments, for each random assignment of offer components to offer component positions, the value or amount of each assigned offer component is different.

In one embodiment, as described above, the gaming system forms an offer if each of the offer component positions of at least one of the offer component position sets are currently occupied. In another embodiment, the gaming system forms an offer if each of the offer component positions of a plurality of the offer component position sets are currently occupied. In another embodiment, the gaming system forms an offer if each of a designated quantity of the offer component positions of at least one of the offer component position sets are currently occupied. In this embodiment, if the player rejects the offer, the offer component position set with the designated quantity of occupied offer component positions is configured to receive one or more additionally assigned offer components until such offer component position set is eliminated. For example, if an offer component position set includes ten offer component positions and the designated quantity of occupied offer component positions is eight offer component positions, then while the assignment of the eighth offer component into the eighth offer component position of this offer component position set triggers a formation of an offer, this offer component position set may still be assigned two additional offer components before this offer component position set is eliminated (in association with any third assigned offer component).

In one embodiment, as described above, the gaming system automatically assigns offer components to offer component positions until each of the offer component positions of at least one of the offer component position sets are occupied. In another embodiment, after each assignment of one or more offer components to the offer component positions of the offer component position sets, the gaming system enables the player to accept a current offer (of each of the award values associated with each of the offer components currently occupying the offer component positions of the offer component position sets) or continue with the assignment of offer components to offer component positions.

In one embodiment, as described above, the gaming system simultaneously assigns offer components to a plurality of offer component positions sets. In another embodiment, the gaming system sequentially assigns offer components to offer component position sets. That is, the gaming system assigns offer components, such as variable quantities of offer components, to offer component positions of one offer component position set at a time. In this embodiment, after each offer component assignment, the gaming system enables the player to accept the offer components assigned to the offer component positions of the current offer component set or continue on with another offer component assignment. In this embodiment, if the player accepts the offer components assigned to the offer component positions of the current offer component set, the gaming system proceeds to any subsequent offer component position sets. In one such embodiment, if the player rejects the offer components assigned to the offer component positions of the current offer component set and the subsequent offer component assignment causes the current offer component set to be eliminated (as described above), the gaming system provides the player any previously accepted offers and terminates the play of the offer and acceptance game with the play. In another such embodiment, if the player rejects the offer components assigned to the offer component positions of the current offer component set and the subsequent offer component assignment causes the current offer component set to be eliminated (as described above), the gaming system proceeds to any subsequent offer component position sets.

In another embodiment, the gaming system displays one or more offer components to the player prior to assigning such offer components to the offer component sets. In one embodiment, the gaming system displays the offer components which will be subsequently assigned in the order which such offer components will be subsequently assigned. In one embodiment, the gaming system displays the offer components which will be subsequently assigned, but not in the order which such offer components will be subsequently assigned. In another embodiment, the gaming system displays a pool of offer components, wherein one or more of the displayed offer components will be subsequently assigned and one or more of the displayed offer components will not be subsequently assigned. It should be appreciated that in these embodiments, displaying one or more offer components (associated with one or more award values, one or more offer component set eliminator and/or offer component set modifiers) which will be subsequently assigned to one or more offer component positions of one or more offer component position sets evocates an element of strategy or skill in how the player plays the offer and acceptance game.

Figure 3:
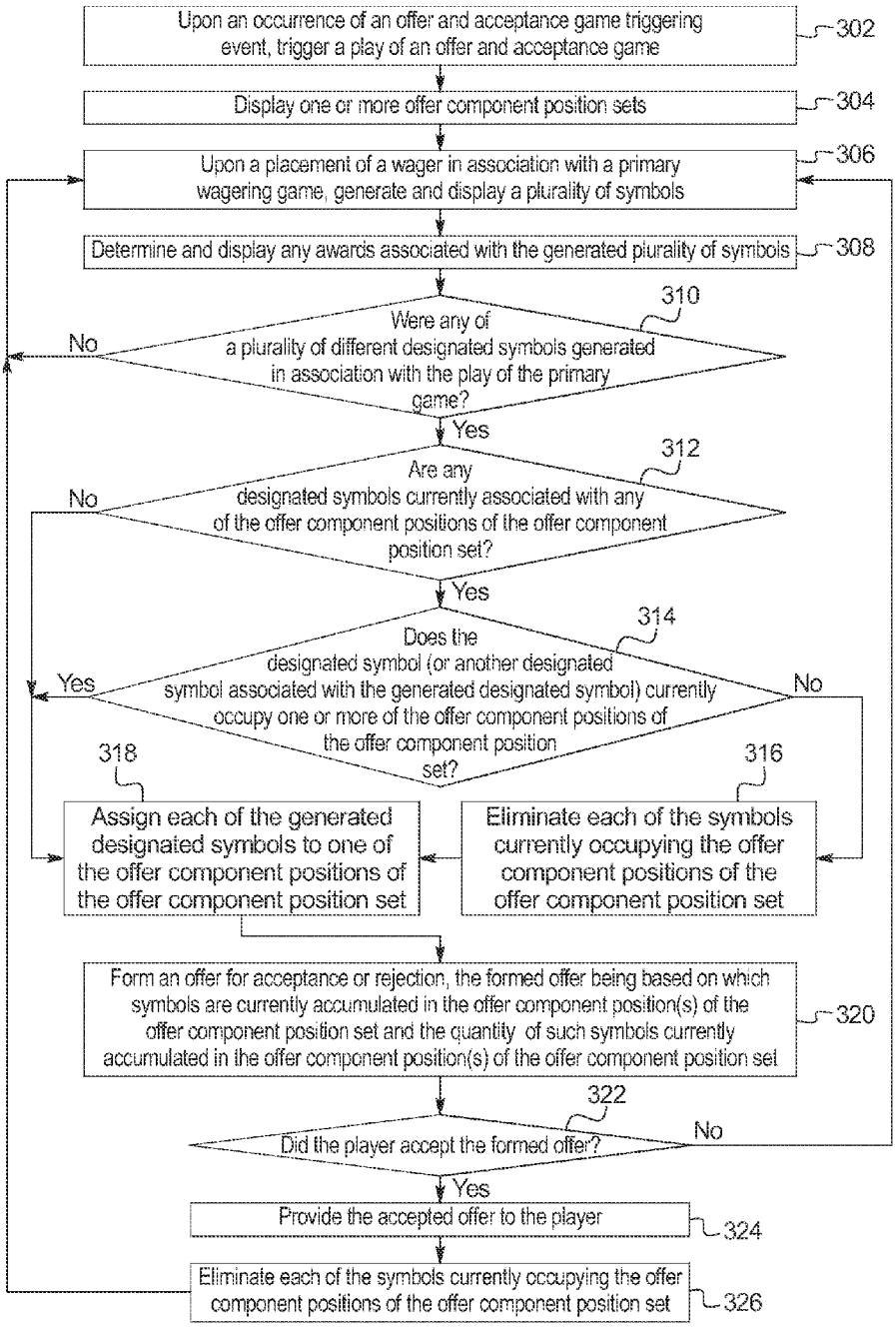
FIG. 3 is a flow chart an example process for operating a gaming system providing one embodiment of a persistent offer and acceptance game disclosed herein.

Referring now to FIG. 3, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 3, it should be appreciated that many other methods of performing the acts associated with this process may be used. For example, the order of certain steps described may be changed, or certain steps described may be optional.

In one embodiment, upon an occurrence of an offer and acceptance game triggering event, as indicated in block 302 of FIG. 3, the gaming system triggers a play of an offer and acceptance game. In one embodiment, the offer and acceptance game is an ongoing secondary or bonus game wherein an offer and acceptance game triggering event occurs based on a displayed event associated with a wagered on play of a primary game. In another such embodiment wherein the offer and acceptance game is an ongoing secondary or bonus game, an offer and acceptance game triggering event occurs based on an event independent of any displayed event associated with a wagered on play of a primary game. In these embodiments, the offer and acceptance game is an ongoing or persistence game wherein the play of the offer and acceptance game spans or is otherwise associated with one or more plays of one or more primary games.

Following the triggering of the offer and acceptance game, the gaming system displays one or more offer component position sets or groups as indicated in block 304. Each offer component position set includes a plurality of offer component positions. As described below, each offer component position of these embodiments is configured to accumulate, be occupied by or otherwise house at least one offer component, such as one of a plurality of generated primary game symbols.

In addition to displaying one or more offer component position sets of the persistent offer and acceptance game, upon a placement of a wager in association with a primary wagering game, the gaming system generates and displays a plurality of symbols as indicated in block 306 of FIG. 3. The gaming system then determines and displays any awards associated with the generated plurality of symbols as indicated in block 308.

In addition to determining and displaying any awards associated with any generated symbol combinations, the gaming system determines if any of a plurality of different designated symbols were generated in association with the play of the primary game as indicated in diamond 310. That is, the gaming system determines if any of the generated primary game symbols are any of a plurality of different designated symbols.

If the gaming system determines that no designated symbols were generated in association with the play of the primary game, the gaming system returns to block 306 and awaits another wager to be placed on another play of the primary wagering game.

On the other hand, if the gaming system determines that at least one designated symbol was generated in association with the play of the primary game, the gaming system determines if any designated symbols (i.e. any offer components) are currently associated with any of the offer component positions of the offer component position set as indicated in diamond 312. Put differently, the gaming system determines if the offer component position set is currently empty or associated with at least one previously generated designated symbol (i.e., at least one previously accumulated offer component).

If the gaming system determines that at least one designated symbol (i.e., at least one offer component) is currently associated with at least one of the offer component positions of the offer component position set, the gaming system determines if the designated symbol (or another designated symbol related to, associated with or otherwise linked to the generated designated symbol) currently occupies one or more of the offer component positions of the offer component position set as indicated in diamond 314. That is, the gaming system determines if the offer component position set currently houses or holds the generated designated symbol or another designated symbols associated with or otherwise linked to the generated designated symbol.

If the gaming system determines that the generated designated symbol (or another designated symbol related to, associated with or otherwise linked to the generated designated symbol) does not currently occupy any of the offer component positions of the offer component position set, the gaming system eliminates each of the symbols currently occupying the offer component positions of the offer component position set as indicated in block 316. In other words, if any accumulated symbols different from or otherwise do not match the generated designated symbol (or another designated symbol related to, associated with or otherwise linked to the generated designated symbol), the gaming system removes or eliminates such different accumulated symbols.

Following this elimination of any accumulated symbols or if the gaming system determines that either: (i) the offer component position set is currently empty, or (ii) the generated designated symbol (or another designated symbol related to, associated with or otherwise linked to the generated designated symbol) currently occupies one or more of the offer component positions of the offer component position set, then as indicated in block 318, the gaming system assigns each of the generated designated symbols to one of the offer component positions of the offer component position set.

Following the assignment of the generated designated symbol(s) to the offer component position(s) of the offer component position set, as indicated in block 320, the gaming system forms an offer for acceptance or rejection. As further indicated in block 320, this formed offer is based on which symbols are currently accumulated in the offer component position(s) of the offer component position set and the quantity of such symbols currently accumulated in the offer component position(s) of the offer component position set. Put differently, the gaming system determines an offer based on which primary game symbol are accumulated and how many matching or otherwise related primary game symbols are consecutively accumulated.

In at least one embodiment, different quantities of accumulated primary game symbols are associated with different award values which the gaming system offers to the player to accept or reject. For example, a first quantity of a first accumulated primary game symbol is associated with a first award value (which forms a first offer for the player to accept or reject) and a second, different quantity of the first accumulated primary game symbol is associated with a second, different award value (which forms a second offer for the player to accept or reject). In at least another embodiment, different accumulated primary game symbols are associated with different award values which the gaming system offers to the player to accept or reject. For example, a first quantity of a first accumulated primary game symbol is associated with a first award value (which forms a first offer for the player to accept or reject) and the first quantity of a second accumulated primary game symbol is associated with a second, different award value (which forms a second offer for the player to accept or reject).

Following the formation of an offer based on the currently accumulated symbols (i.e., the currently accumulated offer components), the gaming system enables the player to accept or reject the formed offer as indicated in diamond 322.

If the player accepts the formed offer, the gaming system provides the accepted offer to the player and eliminates each of the symbols currently occupying the offer component positions of the offer component position set as indicated in blocks 324 and 326. The gaming system then returns to block 306 and awaits another wager to be placed on another play of the primary wagering game. On the other hand, if the player rejects the formed offer, the gaming system returns to block 306 and awaits another wager to be placed on another play of the primary wagering game. Accordingly, the offer and acceptance game of these embodiments is a persistence game which occurs over a plurality of plays of the primary game.

It should thus be appreciated that in these embodiments, as the gaming system determines each offer based on the quantity of matching or otherwise related primary game symbols which are consecutively accumulated, each time the player rejects an offer, the player risks that the next primary game symbol accumulated will not match or otherwise be related to the previously accumulated primary game symbols and the next offer will be a lower offer. Accordingly, these embodiments employ an element of strategy or skill as the player continuously weighs different options available and how such different options affect the offers available to the player.

Figure 4A:
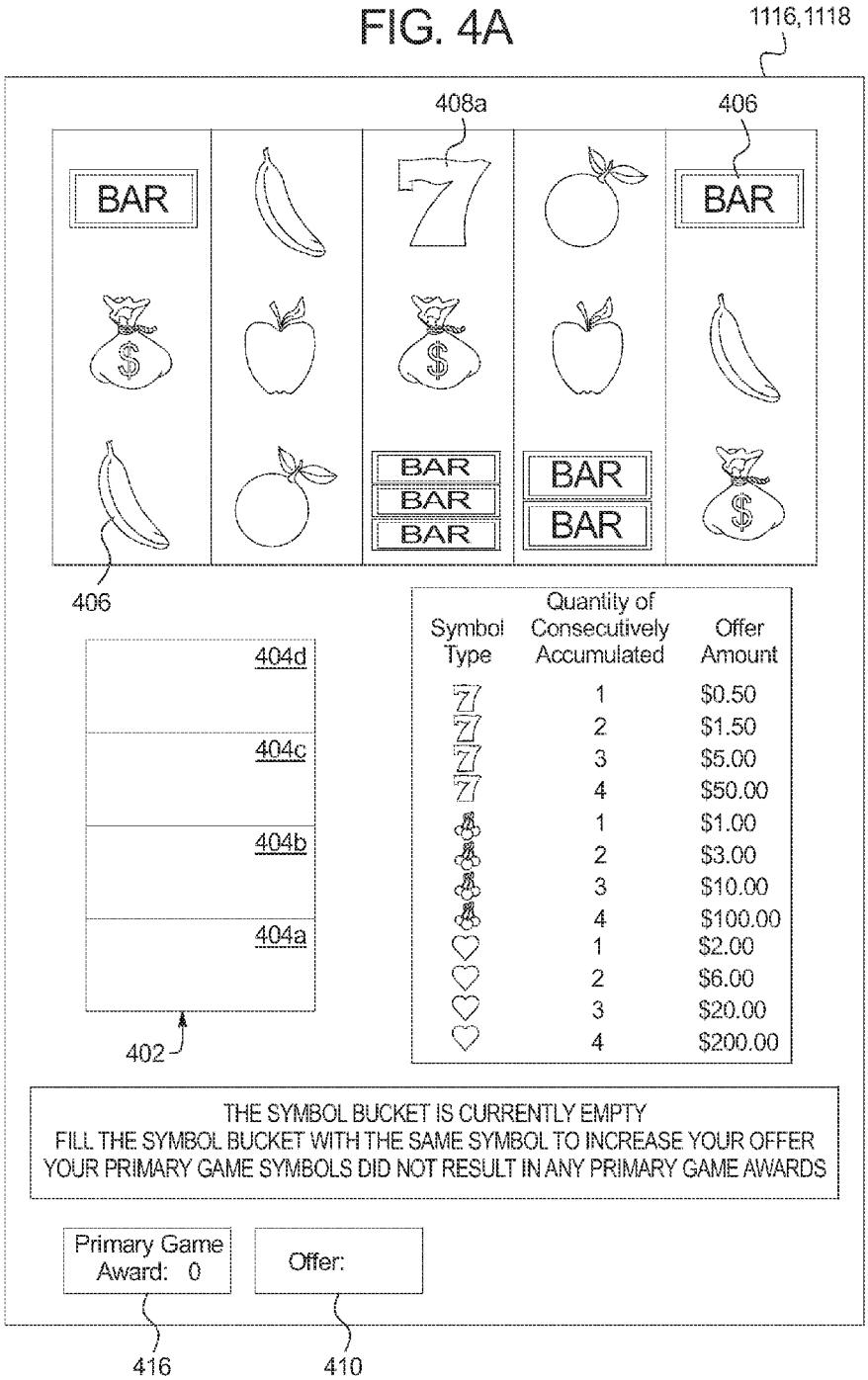
FIGS. 4A, 4B, 4C and 4D are front views of one embodiment of the gaming system disclosed herein illustrating an offer and acceptance game including an accumulation of a plurality of generated primary game symbols.

In one example of a play of a persistent offer and acceptance game, as seen in FIG. 4A, the gaming system displays an offer component position set 402 including four offer component positions 404*a* to 404*d*. In this example, no primary game symbols (i.e., no offer components) currently reside in any of the offer component positions of offer component position set 402. In this example, the gaming system provides appropriate messages such as "THE SYMBOL BUCKET IS CURRENTLY EMPTY", and "FILL THE SYMBOL BUCKET WITH THE SAME SYMBOL TO INCREASE YOUR OFFER" to the player visually, or through suitable audio or audiovisual displays.

As also seen in FIG. 4A, upon a placement of a wager of $0.50, the gaming system generates a plurality of primary game symbols 406, including a designated seven symbol 408*a*. In this example, the gaming system determined that the generated symbols are not associated with any awards and thus does not provide the player any primary game award for the generated primary game symbols (as indicated in primary game award display 416). In this example, the gaming system provides appropriate messages such as "YOUR PRIMARY GAME SYMBOLS DID NOT RESULT IN ANY PRIMARY GAME AWARDS" to the player visually, or through suitable audio or audiovisual displays.

Figure 4B:
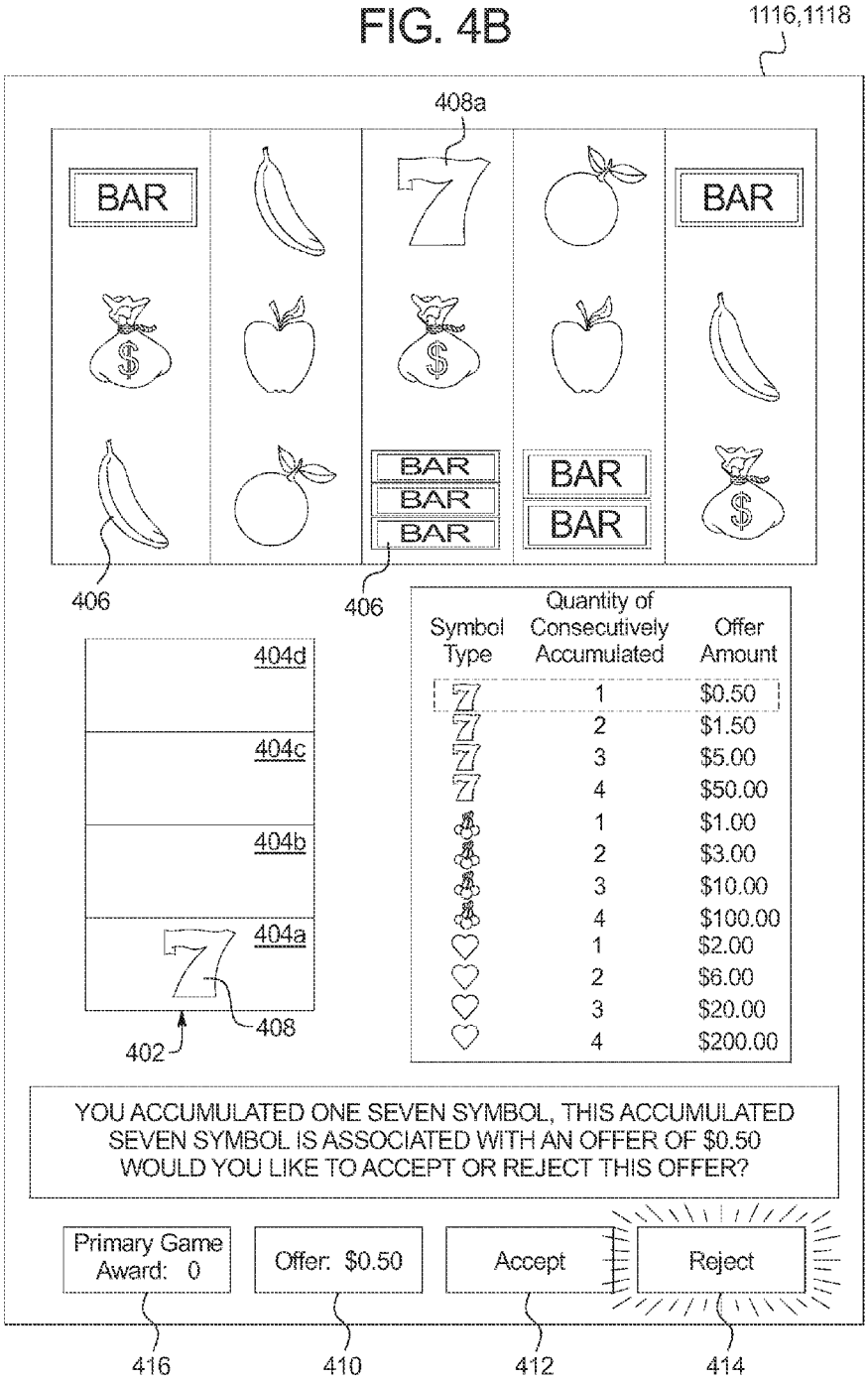

As seen in FIG. 4B, in addition to determining any awards associated with the generated primary game symbols, the gaming system causes the generated seven symbol 408*a* to occupy offer component position 404*a* as a first accumulated offer component. That is, since the offer component positions of the offer component position set were each unoccupied, the gaming system assigned the generated seven symbol (i.e., the generated designated symbol) to one of the offer component positions of the offer component position set. Based on this single accumulated designated symbol, the gaming system forms an offer 410 of $0.50. The gaming system enables the player to accept or reject this formed offer which the player rejects using the reject offer input 414. In this example, the gaming system provides appropriate messages such as "YOU ACCUMULATED ONE SEVEN SYMBOL", "THIS ACCUMULATED SEVEN SYMBOL IS ASSOCIATED WITH AN OFFER OF $0.50" and "WOULD YOU LIKE TO ACCEPT OR REJECT THIS OFFER?" to the player visually, or through suitable audio or audiovisual displays.

Figure 4C:
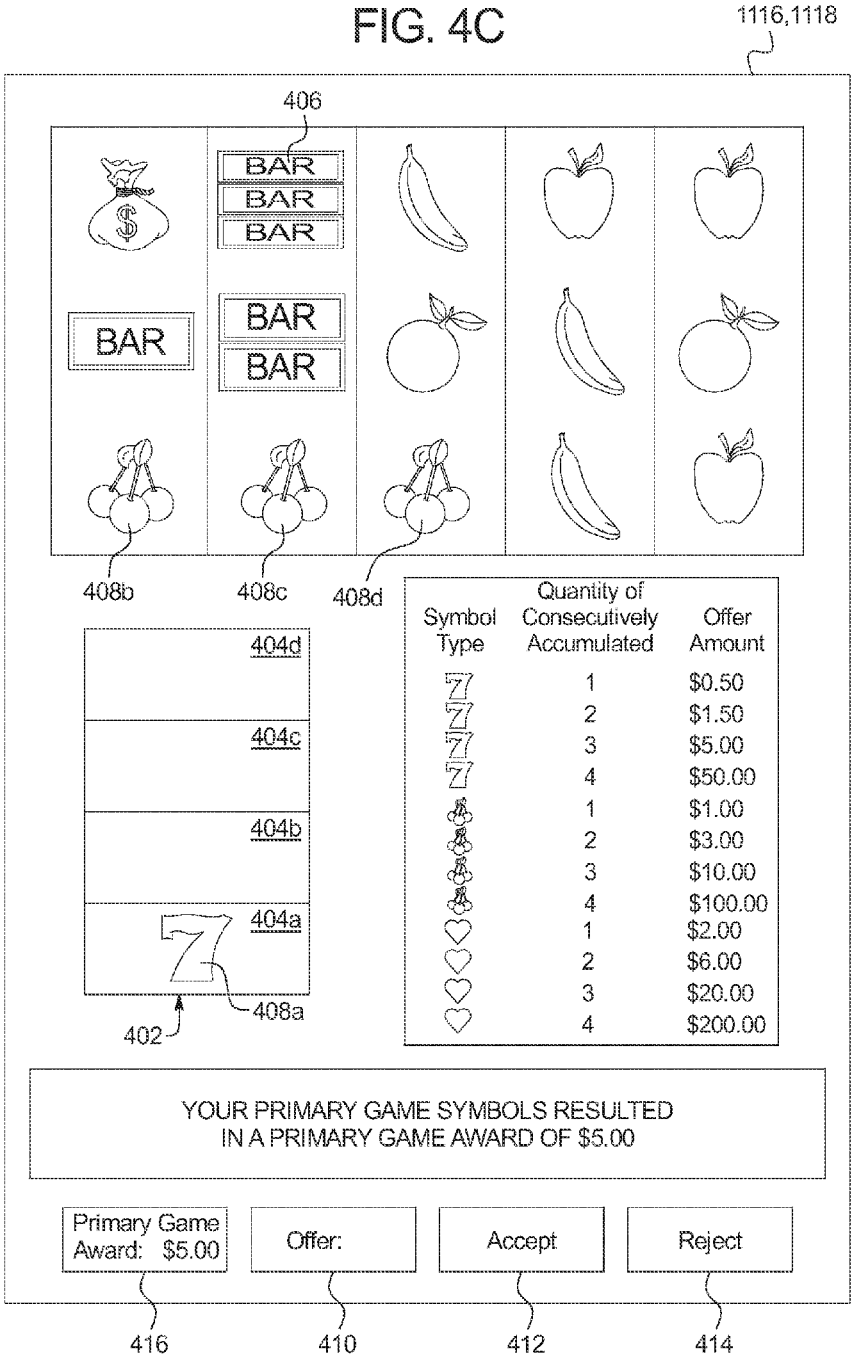
Figure 4D:
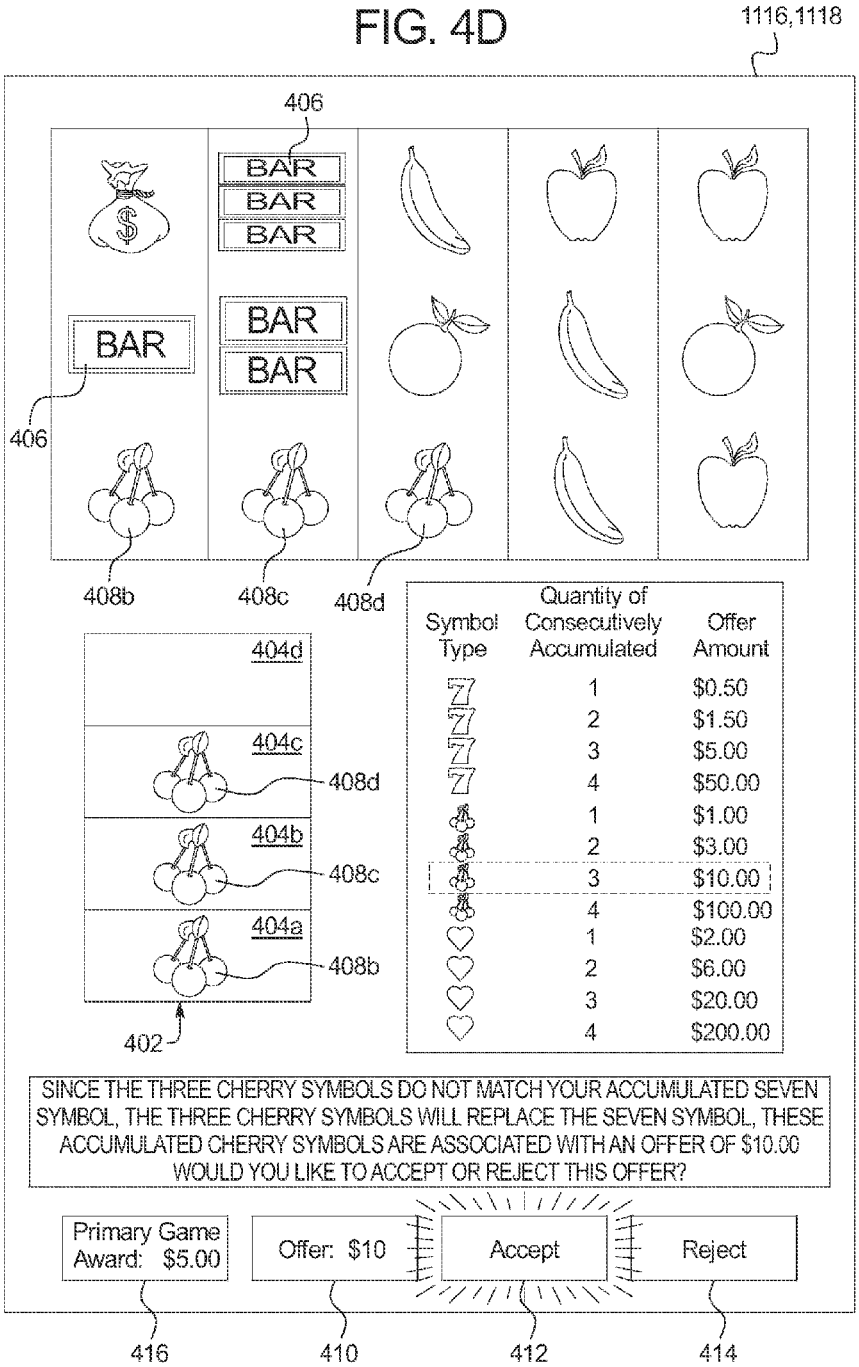

Turning to FIG. 4C, following this rejection of the formed offer, the gaming system returned to the primary game and upon another placement of a wager of $0.50, the gaming system generates another plurality of primary game symbols 406, including three designated cherry symbols 408*b*, 408*c* and 408*d*. In this example, the gaming system determined that the three generated cherry symbols are associated with an award of five dollars and thus the gaming system provides the player this primary game award of five dollars (as indicated in primary game award display 416). In this example, the gaming system provides appropriate messages such as "YOUR PRIMARY GAME SYMBOLS RESULTED IN A PRIMARY GAME AWARD OF $5.00" to the player visually, or through suitable audio or audiovisual displays.

As seen in FIGS. 4C to 40, in addition to determining any awards associated with the generated primary game symbols, the gaming system determined that the generated seven symbol (i.e., the first type of designated symbol) currently accumulated in one of the offer component positions of the offer component set did not match or was otherwise not associated with the three generated cherry symbols (i.e., the second type of designated symbol). Accordingly, the gaming system eliminated this non-matching seven symbol and caused the three generated cherry symbols 408*b*, 408*c* and 408*d* to occupy offer component positions 404*a*, 404*b* and 404*c* as three accumulated offer components. In this example, since at least one of the offer component positions of the offer component position set was occupied with an unmatching designated symbol, the gaming system eliminated this unmatching designated symbol and assigned different designated symbols to three of the offer component positions of the offer component position set. Based on these three accumulated designated symbol, the gaming system forms an offer 410 of $10.00. The gaming system enables the player to accept or reject this formed offer which the player accepts using the accept offer input 414. In this example (not shown), the player's acceptance of the formed offer causes the gaming system to eliminate each of the accumulated symbols associated with the formed offer. In this example, the gaming system provides appropriate messages such as "SINCE THE THREE CHERRY SYMBOLS DO NOT MATCH YOUR ACCUMULATED SEVEN SYMBOL, THE THREE CHERRY SYMBOLS WILL REPLACE THE SEVEN SYMBOL", "THESE ACCUMULATED CHERRY SYMBOLS ARE ASSOCIATED WITH AN OFFER OF $10.00" and "WOULD YOU LIKE TO ACCEPT OR REJECT THIS OFFER?" to the player visually, or through suitable audio or audiovisual displays.

In one embodiment, the offer amounts for different quantities of consecutively accumulated symbols remain the same regardless of the player's primary game wager. In another embodiment, the offer amounts for different quantities of consecutively accumulated symbols are based on the players primary game wager. For example, the offer amount table illustrated in FIGS. 4A to 4D is associated with the wager amount of $0.50. In this embodiment, if the player changes the wager placed on the primary games associated with the persistent offer and acceptance game, the gaming system modifies the offer amounts for different quantities of consecutively accumulated symbols. In one such embodiment, to account for different wagers placed over different plays of the primary game wherein designated symbols are accumulated in association with such different plays of the primary game, the gaming system assigns award values to the accumulated designated symbols as such designated symbols are accumulated.

For example, using the offer amount table illustrated in FIGS. 4A to 40, if a first cherry symbol is accumulated in the offer component position set with the player's wager amount of $0.50, the first cherry symbol is associated with an offer component award value of $1.00. In this example, if the player then changed their wager amount to $1.00 for another play of the primary wager game and a second cherry symbol was generated (without any intervening non-matching seven symbols or heart symbols which would cause the elimination of the accumulated cherry symbol) the second cherry symbol is associated with an offer component award value of $4.00. That is, the additional worth of the second cherry symbol is $2.00 (or the offer component award value of $3.00 for two cherry symbols minus the offer component award value of $1.00 for one cherry symbol), such that if the player doubles their bet from $0.50 to $1.00, the second cherry symbol is associated with an offer component award value of $4.00 ($2.00 additional worth of the second cherry symbol×2 for the player doubling their wager). At this point in time of this example, the formed offer associated with the accumulation of both cherry symbols is $5.00 (an offer component award value of $1.00 for the first accumulated cherry symbol and an offer component award value of $4.00 for the second accumulated cherry symbol).

Continuing on with this example, if the player then changed their wager amount to $0.25 for another play of the primary wager game and a third cherry symbol was generated (without any intervening non-matching seven symbols or heart symbols which would cause the elimination of the two accumulated cherry symbols) the third cherry symbol is associated with an offer component award value of $3.50. That is, the additional worth of the third cherry symbol is $7.00 (or the offer component award value of $10.00 for three cherry symbols minus the offer component award value of $3.00 for two cherry symbols), such that if the player halves their bet from $0.50 to $0.25, the third cherry symbol is associated with an offer component award value of $3.50 ($7.00 additional worth of the third cherry symbol×½ for the player halving their wager). At this point in time, the formed offer associated with the accumulation of the three cherry symbols is $8.50 (an offer component award value of $1.00 for the first accumulated cherry symbol, an offer component award value of $4.00 for the second accumulated cherry symbol and an offer component award value of $3.50 for the third accumulated cherry symbol).

In one embodiment, as illustrated in FIGS. 4A to 4D, the gaming system accumulates designated symbols if such designated symbols are generated. In another embodiment, the gaming system accumulates designated symbols if such designated symbols are generated as part of a winning symbol combination. In another embodiment, the gaming system accumulates designated symbols if such designated symbols are generated as part of a losing symbol combination. In another embodiment, the gaming system accumulates designated symbols if such designated symbols are generated on a designated reel. In another embodiment, the gaming system accumulates designated symbols if such designated symbols are generated in a designated symbol display position.

In one embodiment, if a plurality of different designated symbols are generated for the same play of the primary game, the gaming system accumulates such symbols based on one or more game play accumulation rules. In one such embodiment, a game play accumulation rule includes that the gaming system accumulates any designated symbols which match any currently accumulated designated symbols while the gaming system discards the generated designated non-matching symbols, in another such embodiment, a game play accumulation rule includes that the gaming system accumulates any designated symbols in the order such designated symbols were generated. In another such embodiment, a game play accumulation rule includes that the gaming system accumulates the more lucrative designated symbols. In another such embodiment, a game play accumulation rule includes that the gaming system accumulates any designated symbols based on the quantity of designated symbols generated. In another such embodiment, a game play accumulation rule includes that the gaming system accumulates the designated symbols that results in the highest payout for the player.

In one embodiment, one or more of the generated primary game symbols are associated with a triggering of a secondary game. In this embodiment, different quantities of consecutively accumulated matching or otherwise related primary game symbols determines one or more features of the secondary game. For example, one accumulated designated primary game symbol is associated with a secondary game of one free spin of the reels, two consecutively accumulated matching (or otherwise related) designated primary game symbols are associated with a secondary game of three free spins of the reels, three consecutively accumulated matching (or otherwise related) designated primary game symbols are associated with a secondary game of ten free spins of the reels, and four consecutively accumulated matching (or otherwise related) designated primary game symbols are associated with a secondary game of one-hundred free spins of the reels. In these embodiments, the gaming system forms an offer of a play of a secondary game and enables the player to accept or reject the offer. If the player accepts the formed offer, the gaming system enables the player to play the secondary game with the features of that secondary game. On the other hand, if the player rejects the formed offer, the gaming system continues accumulating designated primary game symbols as described above.

In another embodiment, one or more of the designated primary game symbols accumulated are associated with wild symbols. In this embodiment, such wild symbols, if accumulated, substitute for certain other accumulated primary game symbols, thus matching with the previous or subsequent primary game symbols accumulated in the offer component position set.

In different embodiments, for various of the offer and acceptance games disclosed herein, one or more of the offer components (i.e., offer components or accumulated primary game symbols) are associated with offer component set eliminators. In this embodiment, if the gaming system causes an offer component associated with an offer component set eliminator to occupy an offer component position of an offer component set, the gaming system eliminates that offer component set as described above. That is, regardless of if any offer component positions remain unoccupied in an offer component position set, the occupancy of an offer component associated with an offer component set eliminator eliminates that offer component set from any subsequent offer formation determinations.

In different embodiments, for various of the offer and acceptance games disclosed herein, one or more of the offer components (i.e., offer components or accumulated primary game symbols) are associated with offer component set modifier. In this embodiment, if the gaming system causes an offer component associated with an offer component set modifier to occupy an offer component position of an offer component set, the gaming system modifiers that offer component set. In one embodiment, the modification includes expanding the quantity of offer component positions of that offer component set. In this embodiment, this expansion results in more offer components being assigned to the offer component positions of the expanded offer component position set and greater award offers. In one embodiment, the modification includes contracting the quantity of offer component positions of that offer component set. In this embodiment, this contraction results in less offer components being assigned to the offer component positions of the expanded offer component position set. In another embodiment, the modification includes compacting the offer components currently occupying the offer component positions of that offer component set. In this embodiment, this compaction results in more offer components being assigned to the offer component positions of the compacted offer component position set and greater award offers. For example, if a offer component position set includes ten offer component positions and eight of these offer component positions are current occupied with offer components, a compaction of this offer component position set results in causing the eight offer components to occupy four offer component positions (and thus frees up four offer component positions for subsequent offer components).

In different embodiments, for various of the offer and acceptance games disclosed herein, the award associated with one or more of the offer components and/or designated primary game symbols include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage of one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on the internet.

In one embodiment, the gaming system causes at least one display device of the player's gaming device to display the offer and acceptance game. In another embodiment, in addition or in alternative to each gaming device displaying the offer and acceptance game, the gaming system causes one or more community or overhead display devices to display part or all of the offer and acceptance game to one or more other players or bystanders either at a gaming establishment or viewing over a network, such as the internet. In another embodiment, in addition or in alternative to each gaming device displaying the offer and acceptance game, the gaming system causes one or more internet sites to each display the offer and acceptance game such that a player is enabled to log on from a personal web browser. In another such embodiment, the gaming system enables the player to play one or more primary games on one device while viewing the offer and acceptance game from another device. For example, the gaming system enables the player to play one or more primary games on a mobile phone while viewing the status of the offer and acceptance game on a desktop or laptop computer.

In another embodiment, as mentioned above, an offer and acceptance game triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes an offer and acceptance game triggering event to occur.

In another embodiment, as also mentioned above, the gaming system does not provide any apparent reasons to the players for an offer and acceptance game triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one embodiment, an offer and acceptance game triggering event occurs, based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, an offer and acceptance game triggering event occurs, based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, an offer and acceptance game triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, an offer and acceptance game triggering event occurs, based on a quantity of games played. In this embodiment, a quantity of games played is set for when one or more of such events or conditions will occur. In one embodiment, such a set quantity of games played is based on historic data.

In another alternative embodiment, an offer and acceptance game triggering event occurs, based on time. In this embodiment, a time is set for when one or more of such events or conditions will occur. In one embodiment, such a set time is based on historic data.

In another alternative embodiment, an offer and acceptance game triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, an offer and acceptance game triggering event occurs, based on a system determination, including one or more random selections by the central controller. In one embodiment, as described above, the central controller tracks all active gaming devices and the wagers they placed. In one such embodiment, based on the gaming devices state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, an offer and acceptance game triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing an offer and acceptance game triggering event to occur may be implemented in accordance with the gaming system and method disclosed herein.

It should be appreciated that any of the above-described offer and acceptance game triggering events may be combined in one or more different embodiments.

Alternative Embodiments

It should be appreciated that in different embodiments, one or more of:

i. when an offer and acceptance game triggering event occurs;

ii. a quantity of offer component position sets;

iii. a quantity of offer component positions in one or more of the offer component position sets;

iv. a quantity of offer components to assign to one or more offer component positions of one or more of the offer component position sets;

v. a quantity of offer components that occupy each of one or more of the offer component positions;

vi. which awards are associated with which offer components;

vii. an amount of an award associated with one or more of the offer components;

viii. a quantity of offer components displayed prior to assigning such offer components to any offer component positions;

ix. which awards are associated with which offer components displayed prior to assigning such offer components to any offer component positions;

x. a quantity of offer component set eliminators to associated with one or more offer components;

xi. which offer components to associate with offer component set eliminators;

xii. a quantity of offer component set modifiers to associated with one or more offer components;

xiii. which offer components to associate with offer component set modifiers;

xiv. a quantity of primary game symbols which are designated symbols (i.e., offer components);

xv. which primary game symbols are designated symbols;

xvi. if a plurality of offer component position sets are employed, which designated primary game symbols are employed to which offer component position set; and xvii. any determination disclosed herein;

is/are predetermined, randomly determined, randomly determined based on one or more weighted percentages, determined based on a generated symbol or symbol combination, determined based on a random determination by the central controller, determined based on a random determination at the gaming system, determined based on at least one play of at least one game, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of; (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts, As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5A:
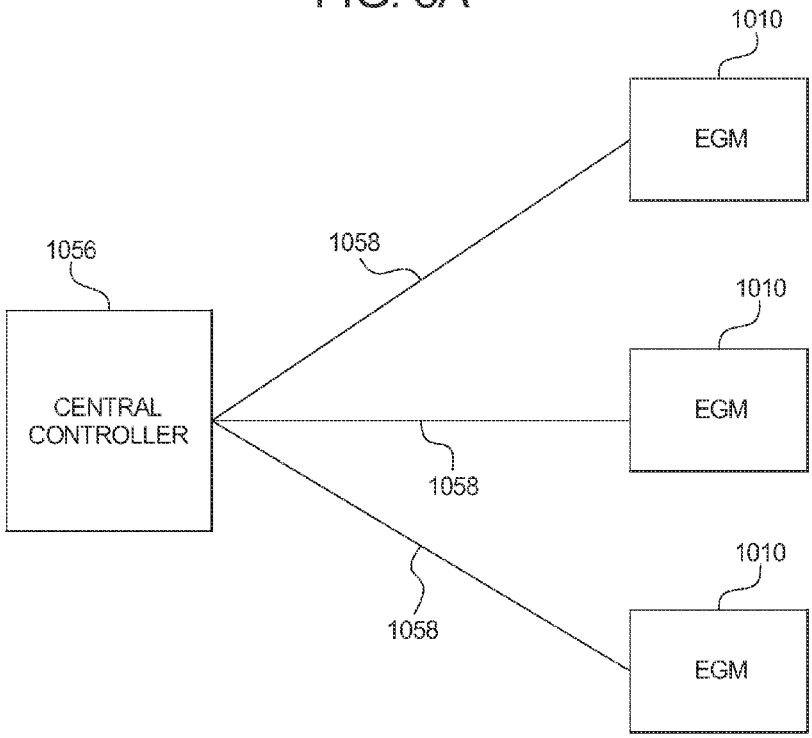
FIG. 5A is a schematic block diagram of one embodiment of a network configuration of the gaming system disclosed herein.
Figure 5B:
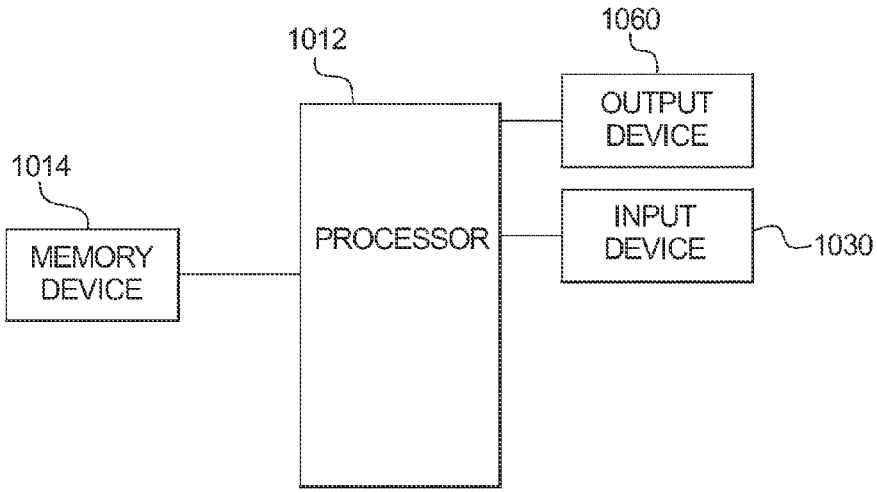
FIG. 5B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
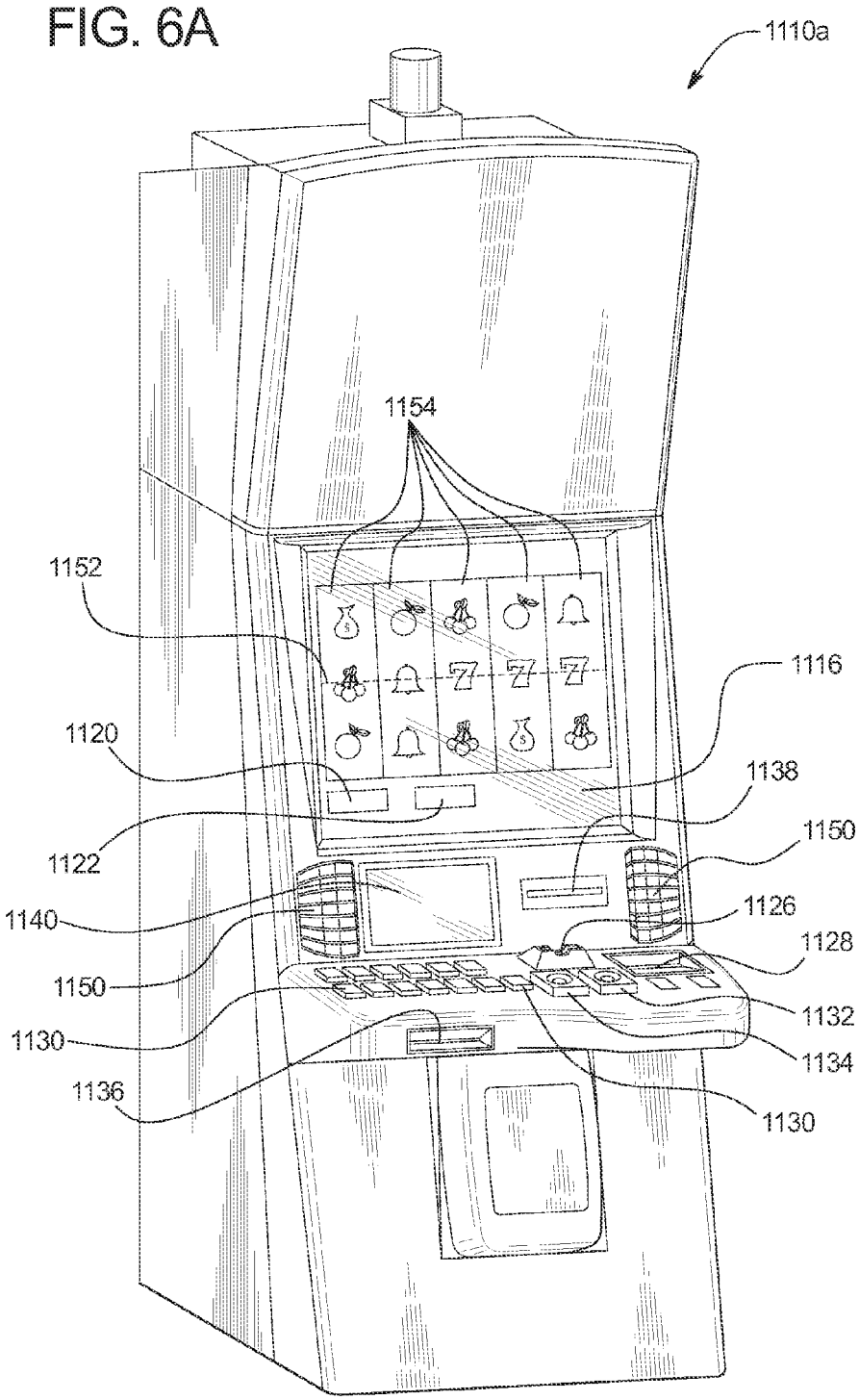
FIGS. 6A and 6B are perspective views of example alternative embodiments of the gaming system disclosed herein.
Figure 6B:
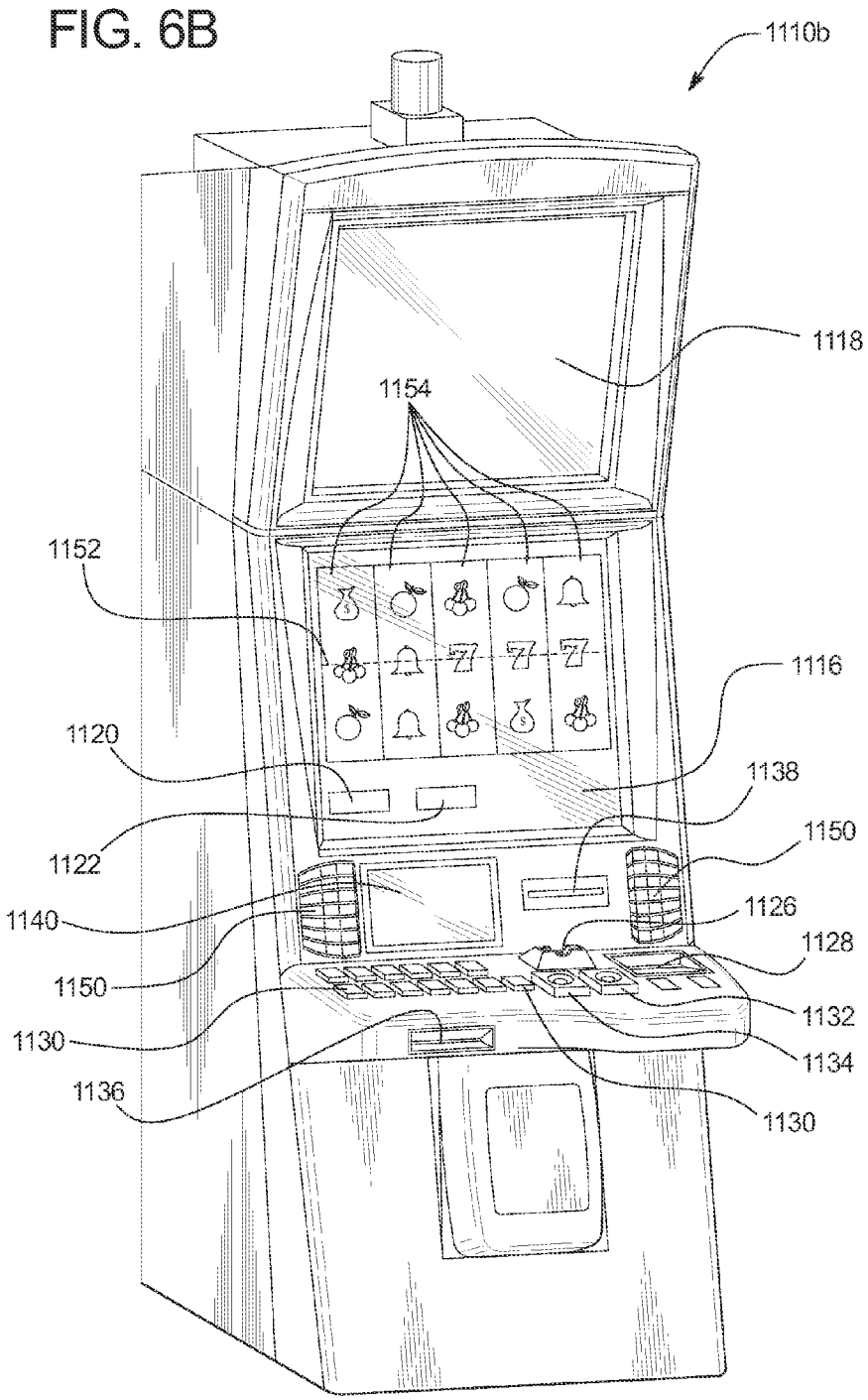

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such players credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system: (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by; (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and U.S. Pat. No. 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 6A and 6B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 200910123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased: rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 200810070680, 200810176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions, which when executed by the at least one processor, cause the at least one processor to operate with the at least one display device and the at least one input device to:

(a) display a plurality of offer component position sets, each offer component position set including a plurality of offer component positions, (b) randomly assign at least one offer component to at least one of the offer component position sets, wherein each randomly assigned offer component is associated with one of a plurality of different award values and occupies one of the offer component positions of one of the offer component position sets, (c) display the assigned offer components occupying the offer component positions of the offer component position sets, (d) repeat (b) until a designated quantity of the offer component positions of at least one of the offer component position sets are occupied with offer components, (e) enable a player to accept or reject a displayed first offer based on the award values associated with the offer components occupying the offer component positions of the offer component position sets, (f) if the player accepts the first offer, provide the player the accepted first offer, and (g) if the player rejects the first offer:

(i) for each of at least one offer component, (A) randomly select one of the offer component position sets, (B) if the selected offer component position set includes at least one unoccupied offer component position, assign said offer component to the selected offer component position set, and (C) if each of the offer component positions of the selected offer component position set are occupied with offer components, eliminate said selected offer component position set, and (ii) enable the player to accept or reject a displayed second offer based on the award values associated with the offer components occupying the offer component positions of the non-eliminated offer component position sets.

2. The gaming system of claim 1, wherein when executed by the at least one processor, the plurality of instructions cause the at least one processor to randomly assign a plurality of offer components to at least one of the offer component position sets.

3. The gaming system of claim 1, wherein when executed by the at least one processor, the plurality of instructions cause the at least one processor to randomly assign a plurality of offer components to the plurality of offer component position sets.

4. The gaming system of claim 1, wherein when executed by the at least one processor if the player rejects the first offer, the plurality of instructions cause the at least one processor to, for each of a plurality of offer components, randomly select one of the offer component position sets.

5. The gaming system of claim 1, wherein when executed by the at least one processor if the player accepts the second offer, the plurality of instructions cause the at least one processor to provide the player the accepted second offer.

6. The gaming system of claim 1, wherein when executed by the at least one processor if the player rejects the second offer, the plurality of instructions cause the at least one processor to:

(i) for each of at least one offer component, (A) randomly select one of the offer component position sets, (B) if the selected offer component position set includes at least one unoccupied offer component position, assign said offer component to the selected offer component position set, and (C) if each of the offer component positions of the selected offer component position set are occupied with offer components, eliminate said selected offer component position set, (ii) if each of the offer component position sets are eliminated, cause an offer and acceptance game termination event to occur, and (iii) if at least one of the offer component position sets remains non-eliminated, enable the player to accept or reject a displayed third offer based on the award values associated with the offer components occupying the offer component positions of the non-eliminated offer component position sets.

7. The gaming system of claim 1, wherein at least one of the offer components is associated with an offer component set eliminator.

8. The gaming system of claim 7, wherein when executed by the at least one processor if the at least one offer component associated with the offer component set eliminator is assigned to one of the offer component position sets, the plurality of instructions cause the at least one processor to eliminate said offer component position set independent of if each of the offer component positions of said offer component position set are occupied with offer components.

9. The gaming system of claim 1, wherein at least one of the offer components is associated with an offer component set modifier.

10. The gaming system of claim 9, wherein when executed by the at least one processor if the at least one offer component associated with the offer component set modifier is assigned to one of the offer component position sets, the plurality of instructions cause the at least one processor to modify a quantity of the plurality of offer component positions of said offer component position set.

11. The gaming system of claim 1, wherein when executed by the at least one processor, the plurality of instructions cause the at least one processor to display at least one of the offer components to the player prior to any assignment of said offer component to any of the offer component positions of any of the offer component position sets.

12. The gaming system of claim 1, wherein the plurality of different award values are selected from the group consisting of: a quantity of monetary credits, a quantity of non-monetary credits, a quantity of promotional credits, a quantity of player tracking points, a progressive award, a modifier, a quantity of free plays of at least one wagering game, a quantity of plays of at least one non-wagering game, a multiplier of a quantity of free plays of a game, at least one lottery based award, a wager match for at least one play of at least one game, an increase in an average expected payback percentage of at least one wagering game, at least one comp, a quantity of credits usable for an online play of an online game, a quantity of virtual goods and an access code usable to unlock content on an internet.

13. The gaming system of claim 1, wherein the designated quantity of the offer component positions includes each of the offer component positions of said offer component position set.

14. A method of operating a gaming system, said method comprising:

(a) causing at least one display device to display a plurality of offer component position sets, each offer component position set including a plurality of offer component positions, (b) causing at least one processor to execute a plurality of instructions to randomly assign at least one offer component to at least one of the offer component position sets, wherein each randomly assigned offer component is associated with one of a plurality of different award values and occupies one of the offer component positions of one of the offer component position sets, (c) causing the at least one display device to display the assigned offer components occupying the offer component positions of the offer component position sets, (d) repeating (b) until a designated quantity of the offer component positions of at least one of the offer component position sets are occupied with offer components, (e) enabling a player to accept or reject a displayed first offer based on the award values associated with the offer components occupying the offer component positions of the offer component position sets, (f) if the player accepts the first offer, providing the player the accepted first offer, and (g) if the player rejects the first offer:

(i) for each of at least one offer component, (A) causing the at least one processor to execute the plurality of instructions to randomly select one of the offer component position sets, (B) if the selected offer component position set includes at least one unoccupied offer component position, causing the at least one processor to execute the plurality of instructions to assign said offer component to the selected offer component position set, and (C) if each of the offer component positions of the selected offer component position set are occupied with offer components, causing the at least one processor to execute the plurality of instructions to eliminate said selected offer component position set, and (ii) enabling the player to accept or reject a displayed second offer based on the award values associated with the offer components occupying the offer component positions of the non-eliminated offer component position sets.

15. The method of claim 14, which includes causing the at least one processor to execute the plurality of instructions to randomly assign a plurality of offer components to at least one of the offer component position sets.

16. The method of claim 14, which includes causing the at least one processor to execute the plurality of instructions to randomly assign a plurality of offer components to the plurality of offer component position sets.

17. The method of claim 14, which includes causing the at least one processor to execute the plurality of instructions to, for each of a plurality of offer components, randomly select one of the offer component position sets, if the player rejects the first offer.

18. The method of claim 14, which includes providing the player the accepted second offer if the player accepts the second offer.

19. The method of claim 14, which includes, if the player rejects the second offer:

(i) for each of at least one offer component, (A) causing the at least one processor to execute the plurality of instructions to randomly select one of the offer component position sets, (B) if the selected offer component position set includes at least one unoccupied offer component position, causing the at least one processor to execute the plurality of instructions to assign said offer component to the selected offer component position set, and (C) if each of the offer component positions of the selected offer component position set are occupied with offer components, causing the at least one processor to execute the plurality of instructions to eliminate said selected offer component position set, (ii) if each of the offer component position sets are eliminated, causing the at least one processor to execute the plurality of instructions to cause an offer and acceptance game termination event to occur, and (iii) if at least one of the offer component position sets remains non-eliminated, enabling the player to accept or reject a displayed third offer based on the award values associated with the offer components occupying the offer component positions of the non-eliminated offer component position sets.

20. The method of claim 14, wherein at least one of the offer components is associated with an offer component set eliminator.

21. The method of claim 20, which includes, if the at least one offer component associated with the offer component set eliminator is assigned to one of the offer component position sets, causing the at least one processor to execute the plurality of instructions to eliminate said offer component position set independent of if each of the offer component positions of said offer component position set are occupied with offer components.

22. The method of claim 14, wherein at least one of the offer components is associated with an offer component set modifier.

23. The method of claim 22, which includes, if the at least one offer component associated with the offer component set modifier is assigned to one of the offer component position sets, causing the at least one processor to execute the plurality of instructions to modify a quantity of the plurality of offer component positions of said offer component position set.

24. The method of claim 14, which includes causing the at least one display device to display at least one of the offer components to the player prior to any assignment of said offer component to any of the offer component positions of any of the offer component position sets.

25. The method of claim 14, wherein the plurality of different award values are selected from the group consisting of: a quantity of monetary credits, a quantity of non-monetary credits, a quantity of promotional credits, a quantity of player tracking points, a progressive award, a modifier, a quantity of free plays of at least one wagering game, a quantity of plays of at least one non-wagering game, a multiplier of a quantity of free plays of a game, at least one lottery based award, a wager match for at least one play of at least one game, an increase in an average expected payback percentage of at least one wagering game, at least one comp, a quantity of credits usable for an online play of an online game, a quantity of virtual goods and an access code usable to unlock content on an internet.

26. The method of claim 14, wherein the designated quantity of the offer component positions includes each of the offer component positions of said offer component position set.

27. The method of claim 14, which is provided through a data network.

28. The method of claim 27, wherein the data network is the internet.

* * * * *